US008660454B2

(12) United States Patent
Lee et al.

(10) Patent No.: US 8,660,454 B2
(45) Date of Patent: Feb. 25, 2014

(54) IMAGE FORMING APPARATUS WITH DEVELOPING UNIT DRAWER

(75) Inventors: Sung Kyun Lee, Seoul (KR); Myoung Sub Jang, Suweon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 82 days.

(21) Appl. No.: 13/314,387

(22) Filed: Dec. 8, 2011

(65) Prior Publication Data

US 2012/0148289 A1 Jun. 14, 2012

(30) Foreign Application Priority Data

Dec. 9, 2010 (KR) ..... 10-2010-00125572

(51) Int. Cl.
*G03G 15/00* (2006.01)
*G03G 21/18* (2006.01)

(52) U.S. Cl.
USPC ..... 399/90; 399/110; 399/111

(58) Field of Classification Search
USPC ..... 399/114
See application file for complete search history.

(56) References Cited

U.S. PATENT DOCUMENTS

| | | | | |
|---|---|---|---|---|
| 3,782,800 | A * | 1/1974 | Remington et al. | 312/333 |
| 6,735,406 | B1 * | 5/2004 | Noda | 399/111 |
| 2008/0159772 | A1 * | 7/2008 | Koishi et al. | 399/90 |
| 2008/0159775 | A1 | 7/2008 | Koishi et al. | |

FOREIGN PATENT DOCUMENTS

JP 2008134317 6/2008

OTHER PUBLICATIONS

European Search Report Issued on Mar. 27, 2012 in EP Patent Application No. 11191811.6.

* cited by examiner

*Primary Examiner* — Clayton E Laballe
*Assistant Examiner* — Jas Sanghera
(74) *Attorney, Agent, or Firm* — Stanzione & Kim, LLP

(57) ABSTRACT

An image forming apparatus includes installation/separation of a high-voltage connector to apply high-voltage current to a developing unit, a connector to transmit developing information, and a coupling connector to connect or disconnect a coupling to transmit power to rollers of the developing unit is performed as a drawer is pushed into or pulled out of a main body.

26 Claims, 24 Drawing Sheets

IMAGE FORMING APPARATUS WITH DEVELOPING UNIT DRAWER

CROSS-REFERENCE TO RELATED APPLICATIONS

This application claims the benefit of priority under 35 U.S.C. §119 to Korean Patent Application No. 2010-0125572, filed on Dec. 9, 2010 in the Korean Intellectual Property Office, the disclosure of which is incorporated herein by reference in its entirety.

BACKGROUND OF THE INVENTION

1. Field of the Invention

The present general inventive concept generally relates to an image forming apparatus having a drawer detachably installed to a main body and configured to receive a developing unit therein.

2. Description of the Related Art

An image forming apparatus is designed to form an image on a printing medium based on an input image signal. Examples of image forming apparatuses include printers, copiers, fax machines, and devices combining functions thereof.

Such an image forming apparatus includes a developing unit in which developer is fed to a photoconductor drum, on which an electrostatic latent image has been formed, to develop the electrostatic latent image into a visible image.

The developing unit conventionally takes the form of a single process cartridge having a housing in which major developing elements, such as a photoconductor drum, charging roller, cleaning roller, developing roller and feed roller, are received.

Recently, to conveniently attach or detach the developing unit to or from a main body of the image forming apparatus, a drawer, in which the developing unit is received, is installed to the main body so as to be slidably pushed into or pulled out of the main body, which assures convenient exchange of the developing unit.

SUMMARY OF THE INVENTION

The present general inventive concept provides an image forming apparatus in which a developing unit is received in a drawer so as to be installed into a main body and connected to a drive device and electric contacts in linkage with opening/closing operations of the drawer.

Aspects and utilities of the present general inventive concept will be set forth in part in the description which follows and, in part, will be obvious from the description, or may be learned by practice of the general inventive concept.

The foregoing and/or other features and utilities of the present general inventive concept may be realized by an image forming apparatus includes a main body, a developing unit to form a visible image by feeding developer onto a photoconductor, a transfer unit placed in the main body to transfer the visible image formed on the photoconductor to a printing medium, a drawer configured to be slidably pushed into or pulled out of the main body and including a tray to support the developing unit and a front cover defining one surface of the main body and coupled to the tray so as to be moved along with the tray after passing through an operating section in which the front cover is moved relative to the tray, a coupling connector including a coupling rack to control connection of a coupling so as to transmit power to at least one inner roller of the developing unit, a Customer Replaceable Unit Module (CRUM) connector to control connection of a terminal so as to transmit developing information to the developing unit, a drive plate coupled to the front cover so as to vertically move the developing unit between a first position where the photoconductor comes into contact with the transfer unit and a second position where the photoconductor is spaced apart from the transfer unit, and a high-voltage connector to control connection of a terminal so as to apply high-voltage current to the developing unit, wherein the coupling connector, the CRUM connector and the high-voltage connector are disconnected respectively and the developing unit is moved to the second position by the drive plate when the front cover is open, and wherein the coupling connector, the CRUM connector and the high-voltage connector are connected respectively and the developing unit is moved to the first position by the drive plate when the front cover is closed.

The coupling rack may be slidably installed to the main body so as to be selectively moved in linkage with movement of the front cover with respect to a part of the operating section, and the CRUM connector may installed to the main body in linkage with movement of the coupling rack such that the CRUM connector is vertically movable, and the high-voltage connector may be installed to the main body in linkage with movement of the tray with respect to a section other than the operating section such that the high-voltage connector is vertically moveable.

The operating section may include a first section in which the front cover is initially pulled out of the main body and a second section in which the front cover is further pulled out of the main body, and the coupling connector and the CRUM connector may be disconnected with respect to the first section, and the developing unit may be moved to the second position with respect to the second section.

The at least one of the front cover and the tray may be provided with an elongated slot defining the operating section, and the other one of the front cover and the tray may be provided with a retainer boss movably inserted in the slot.

The image forming apparatus may further include a first binding unit to bind the coupling rack to the front cover with respect to the first section and to unbind the coupling rack from the front cover with respect to the second section.

The first binding unit may include a coupling operating hook protruding from a rear surface of the front cover, a coupling lever hooked with the coupling operating hook while being rotatably coupled at one end thereof to the coupling rack, the coupling lever having a downwardly-inclined slope at a lower position near the end thereof, and a stud member to upwardly rotate the coupling lever so as to unbind the coupling lever from the coupling operating hook with respect to the second section.

The image forming apparatus may further include a second binding unit to bind the tray so as to limit movement of the tray while the front cover is pulled out of the main body by the operating section and to unbind the tray so as to enable movement of the tray after passing the operating section.

The tray may have a trap hole and the drive plate may have a stepped horizontal guide groove formed in a surface thereof facing the trap hole, and the second binding unit may include a lock-up member rotatably installed about a rotating shaft, the lock-up member being provided at one end thereof with a locking portion extending from the rotating shaft toward the trap hole so as to be caught and supported by the trap hole and at the other end thereof with a guide protrusion extending from the rotating shaft to the guide groove so as to be moved along the guide groove.

The guide groove may include a lower first guide groove having a length corresponding to a length of the operating section, an upper second guide groove to rotate the lock-up member, and an inclined groove connecting the first guide groove and the second guide groove to each other.

The coupling rack may be provided with a coupling slot into which one side of the coupling is inserted and supported, and the coupling slot may be provided with an inclined guide to enable movement of the coupling with respect to the first section.

The CRUM connector may be elastically supported by an elastic member while being located beneath the coupling rack and may include a first guide rib protruding upward from an upper end thereof to have an upwardly-inclined first slope and a first horizontal plane, and the coupling rack may include a second guide rib protruding downward from a lower end thereof to have a downwardly-inclined second slope corresponding to the first slope and a second horizontal plane corresponding to the first horizontal plane.

The first slope and the second slope may be brought into contact with each other, causing the CRUM connector to be pushed upward by the elastic member and be disconnected when the coupling rack is pulled out, and the first horizontal plane and the second horizontal plane may be brought into contact with each other, causing the CRUM connector to be moved downward and connected when the coupling rack is pushed in.

The drive plate may include a position guide portion protruding from an upper end thereof to come into contact with a lower surface of the developing unit so as to guide the developing unit between the first position and the second position, and the position guide portion may include a position raising portion to apply pressure to the developing unit so as to locate the developing unit at the first position with respect to the first section, a position lowering portion to locate the developing unit at the second position, and an inclined guiding portion connecting the position raising portion and the position lowering portion to each other to enable vertical movement of the developing unit with respect to the second section.

The drive plate may further include a pressure unit to elastically support the developing unit at the position raising portion.

The pressure unit may include a lifting member vertically movably installed to the drive plate and a pressure spring to elastically support the lifting member, and the lifting member may include a lifting member slope corresponding to the inclined guiding portion so as to guide the developing unit to the position lowering portion, and a developing unit pressure surface to apply pressure to the developing unit.

The tray may be provided at a side surface thereof with a high-voltage connector lifting guide including a stepped pressure plane and a separation guide slope to enable vertical movement of the high-voltage connector, and the high-voltage connector may include a pressure protrusion to be moved along the high-voltage connector lifting guide and an elastic member to apply elastic force in a direction in which the high-voltage connector is moved downward.

In accordance with another aspect of the present invention, an image forming apparatus includes a main body, at least one developing unit placed in the main body, a transfer unit to transfer a visible image formed on a photoconductor of the at least one developing unit, a drawer including a tray installed to be slidably pushed into or pulled out of the main body and configured to support the at least one developing unit and a front cover configured to open or close one side of the main body and coupled to the tray so as to be moved relative to the tray with respect to a first operating section and be moved along with the tray with respect to a second operating section, a drive plate to move the at least one developing unit between a first position where the photoconductor comes into contact with the transfer unit and a second position where the photoconductor is spaced apart from the transfer unit, a coupling connector to transmit power to at least one inner roller of the at least one developing unit, a high-voltage connector to apply high-voltage current to the at least one developing unit, and a Customer Replaceable Unit Module (CRUM) connector to transmit developing information to the at least one developing unit, wherein the coupling connector and the CRUM connector are connected to or disconnected from the developing unit in linkage and the developing unit is moved between the first position and the second position by the drive plate as the front cover is open or closed with respect to the first operating section, and wherein the high-voltage connector is connected to or disconnected from the developing unit as the tray is pushed in or pulled out with respect to the second operating section.

The drive plate may be coupled to the front cover so as to be moved along with the front cover, the coupling connector and the CRUM connector may be moved in linkage with movement of the front cover with respect to a part of the operating section, and the developing unit may be moved by the drive plate as the front cover is moved by the remaining part of the first operating section.

At least one of the front cover and the tray may be provided with an elongated slot to define the first operating section, and the other one of the front cover and the tray may be provided with a retainer boss movably inserted in the slot.

The coupling connector may include a coupling rack to move a coupling connected to the roller and a coupling lever rotatably installed at one side of the coupling rack, and the front cover may include a coupling operating hook hooked with the coupling lever, and the coupling rack may include an inclined guide to vertically move the coupling according to reciprocating motion of the coupling rack.

The image forming apparatus may further include a stud member to unbind the coupling lever from the coupling operating hook after the front cover is pulled out beyond the part of the first operating section, and the coupling lever may include a downwardly-inclined slope to allow the coupling lever to be rotated upward as the downwardly-inclined slope is brought into contact with the stud member.

The CRUM connector may be elastically supported by an elastic member in a vertically movable manner and may be connected to or disconnected from the developing unit by being vertically moved in linkage with reciprocation motion of the coupling rack.

The CRUM connector may include a first guide rib having an upwardly-inclined first slope and a first horizontal plane, and the coupling rack may include a second guide rib having a downwardly-inclined second slope and a second horizontal plane so as to correspond to the first guide rib.

The drive plate may include a position guide portion composed of a position raising portion to locate the developing unit at the first position, a position lowering portion to locate the developing unit at the second position, and an inclined guiding portion connecting the position raising portion and the position lowering portion to each other.

The drive plate may further include a pressure unit to elastically support the developing unit at the position raising portion.

The pressure unit may include a lifting member vertically movably installed to the drive plate and a pressure spring to elastically support the lifting member, and the lifting member may include a lifting member slope corresponding to the inclined guiding portion so as to guide the developing unit to the position lowering portion, and a developing unit pressure surface to apply pressure to the developing unit.

The image forming apparatus may further include a tray binding unit to limit movement of the tray while the front cover is moved by the first operating section, the tray binding unit may include a lock-up member to bind the tray while the front cover is moved by the first operating section and to unbind the tray after the front cover passes the first operating section.

The tray may have a trap hole and the drive plate may have a stepped horizontal guide groove, and the lock-up member may include a rotating shaft, a locking portion extending from the rotating shaft toward the tray so as to be caught and supported by the trap hole, and a guide protrusion extending from the rotating shaft toward the drive plate so as to be moved along the guide groove.

The stepped guide groove may include a lower first guide groove to allow the locking portion to be caught and supported by the trap hole, and an upper second guide groove to allow the locking portion to be released from the trap hole.

The first guide groove may have a length corresponding to a length of the first operating section.

The tray may include a high-voltage connector lifting guide having a stepped pressure plane and a separation guide slope to allow the high-voltage connector to be vertically moved as the tray is pushed in or pulled out, and the high-voltage connector may be vertically movably supported by an elastic member and may include a pressure protrusion to be moved on the guide slope.

The tray may be pulled out along with the front cover and the high-voltage connector may be moved downward by elasticity of the elastic member so as to be disconnected from the at least one developing unit when the front cover is pulled out of the main body beyond the first operating section.

In accordance with another aspect of the present invention, an image forming apparatus includes a main body, a developing unit placed in the main body, a transfer unit to transfer a visible image formed on a photoconductor of the developing unit, a drawer including a tray installed to be slidably pushed into or pulled out of the main body and configured to support the developing unit and a front cover configured to open or close one side of the main body and coupled to the tray so as to be moved relative to the tray with respect to a first operating section and be moved along with the tray with respect to a second operating section, a drive plate to move the developing unit between a first position where the photoconductor comes into contact with the transfer unit and a second position where the photoconductor is spaced apart from the transfer unit, a coupling connector to transmit power to at least one inner roller of the developing unit, a high-voltage connector to apply high-voltage current to the developing unit, and a Customer Replaceable Unit Module (CRUM) connector to transmit developing information to the developing unit, wherein the coupling connector, the CRUM connector and the high-voltage connector are connected or disconnected and the developing unit is moved between the first position and the second position in linkage with movement of the drawer.

In accordance with a further aspect of the present invention, an image forming apparatus includes a main body, a developing unit placed in the main body, a transfer unit to transfer a visible image formed on a photoconductor of the developing unit, a drawer including a tray installed to be slidably pushed into or pulled out of the main body and configured to support the developing unit, a front cover coupled to the tray so as to open or close one side of the main body, and a grip pivotally rotatably coupled to the front cover, a drive plate to move the developing unit between a first position where the photoconductor comes into contact with the transfer unit and a second position where the photoconductor is spaced apart from the transfer unit, a coupling connector to transmit power to at least one inner roller of the developing unit, a high-voltage connector to apply high-voltage current to the developing unit, and a Customer Replaceable Unit Module (CRUM) connector to transmit developing information to the developing unit, wherein the coupling connector and the CRUM connector are connected to or disconnected from the developing unit and the developing unit is moved between the first position and the second position by the drive plate in linkage with rotation of the grip, and wherein the high-voltage connector is connected to or disconnected from the developing unit as the tray is pushed in or pulled out.

The coupling connector and the drive plate may be installed to perform linear reciprocating motion, and the image forming apparatus may further include a power converting member to convert rotation of the grip into linear movement of the coupling connector and the drive plate.

The foregoing and/or other features and utilities of the present general inventive concept may be realized by an image forming apparatus including a drawer configured to move a predetermined distance into or out of the image forming apparatus, the drawer including a front cover, a tray selectively coupled to the front cover and to support a developing unit, and a drive plate coupled to the front cover, and a coupling connector including a coupling rack to move in linkage with the drawer over a first portion of the predetermined distance to respectively connect and disconnect a drive source and at least one inner roller of the developing unit when the drawer is moved into and out of the image forming apparatus, wherein the drawer moves independent of the coupling rack through the remaining portion of the predetermined distance.

The image forming apparatus may include a Customer Replaceable Unit Module (CRUM) connector installed in the image forming apparatus to be vertically movable between a first position to connect to the developing unit to transmit developing information to the developing unit and a second position to disconnect from the developing unit, and at least one elastic member to bias the CRUM connector to the second position, wherein the coupling rack includes a guide rib to respectively press the CRUM connector to the first position and release the CRUM connector to the second position when the coupling rack moves over the first portion of the predetermined distance when the drawer is slid into and out of the image forming apparatus.

The coupling connector may include a coupling connector binding unit to couple the coupling rack and the drawer over the first portion of the predetermined distance and to decouple the coupling rack over the remaining portion of the predetermined distance.

The coupling connector binding unit may include a coupling lever to couple the coupling rack and the drawer over the first portion of the predetermined distance while the drawer is moved out of the image forming apparatus, and a stud slot to press against a stud to couple the coupling rack and the drawer over the first portion of the predetermined distance while the drawer is moved into the image forming apparatus.

The foregoing and/or other features and utilities of the present general inventive concept may be realized by a drawer of an image forming apparatus, the drawer including a front cover to form an outer surface of the image forming apparatus and configured to move a predetermined distance away from the image forming apparatus when the drawer is opened, a drive plate coupled to the front cover and to lift a developing unit to contact a transfer unit when the drawer is closed, and a tray to support the developing unit and selectively coupled to the front cover so as to remain stationary while the front cover is moved a first portion of the predetermined distance away from the image forming apparatus and to move in linkage with the front cover while the front cover is moved a remaining portion of the predetermined distance away from the image forming apparatus.

The drive plate may include a position raising portion, a position lowering portion disposed at a lower height than the position raising portion, and an inclined guiding portion disposed between the position raising portion and the position lowering portion such that the developing unit slides up the inclined guiding portion from the position lowering portion to the position raising portion when the drawer is closed.

The drawer may include a slot formed in the front cover, and a retainer boss coupled to the tray such that the retainer boss presses against an end of the slot after the front cover is moved the first portion of the predetermined distance away from the image forming apparatus to couple the tray and the front cover.

The foregoing and/or other features and utilities of the present general inventive concept may be realized by an image forming apparatus including a developing unit to develop a latent image on a photoconductor, a drive source to provide power to at least one inner roller of the developing unit, a transfer unit to transfer the latent image developed by the developing unit to a printing medium, a Customer Replaceable Unit Module (CRUM) connector to control connection of a terminal so as to transmit developing information to the developing unit, a high-voltage connector to control connection of a terminal so as to apply high-voltage current to the developing unit, a drawer including a front cover to form an outer surface of the image forming apparatus and configured to move a predetermined distance away from the image forming apparatus when the drawer is opened, the predetermined distance including a first portion, a second portion, and a third portion, a drive plate coupled to the front cover and to lift a developing unit to contact the transfer unit when the drawer is closed, and a tray to support the developing unit and selectively coupled to the front cover so as to remain stationary while the front cover is moved the first and second portions of the predetermined distance away from the image forming apparatus and to move in linkage with the front cover while the front cover is moved the third portion of the predetermined distance away from the image forming apparatus to disconnect the high-voltage connector, and a coupling connector including a coupling rack to move in linkage with the front cover over the first portion of the predetermined distance to disconnect the drive source and the at least one inner roller of the developing unit and to disconnect the CRUM connector and the developing unit when the drawer is opened, wherein the coupling rack remains stationary when the front cover is moved the second and third portions of the predetermined distance away from the image forming apparatus when the drawer is opened.

The drive plate further may include a position raising portion to press against the developing unit to lift the developing unit to contact the transfer unit when the drawer is closed.

The tray may include at least one lifting guide formed on a side of the tray to press against the high-voltage connector to connect the high-voltage connector when the drawer is closed and to release the high-voltage connector to disconnect the high-voltage connector when the drawer is opened.

The coupling rack may include a guide rib to press against the CRUM connector to connect the CRUM connector when the drawer is closed and to release the CRUM connector to disconnect the CRUM connector when the drawer is opened.

BRIEF DESCRIPTION OF THE DRAWINGS

Exemplary embodiments of the present general inventive concept will be more clearly understood from the following detailed description taken in conjunction with the accompanying drawings in which.

DETAILED DESCRIPTION OF THE EMBODIMENTS

Figure 1:
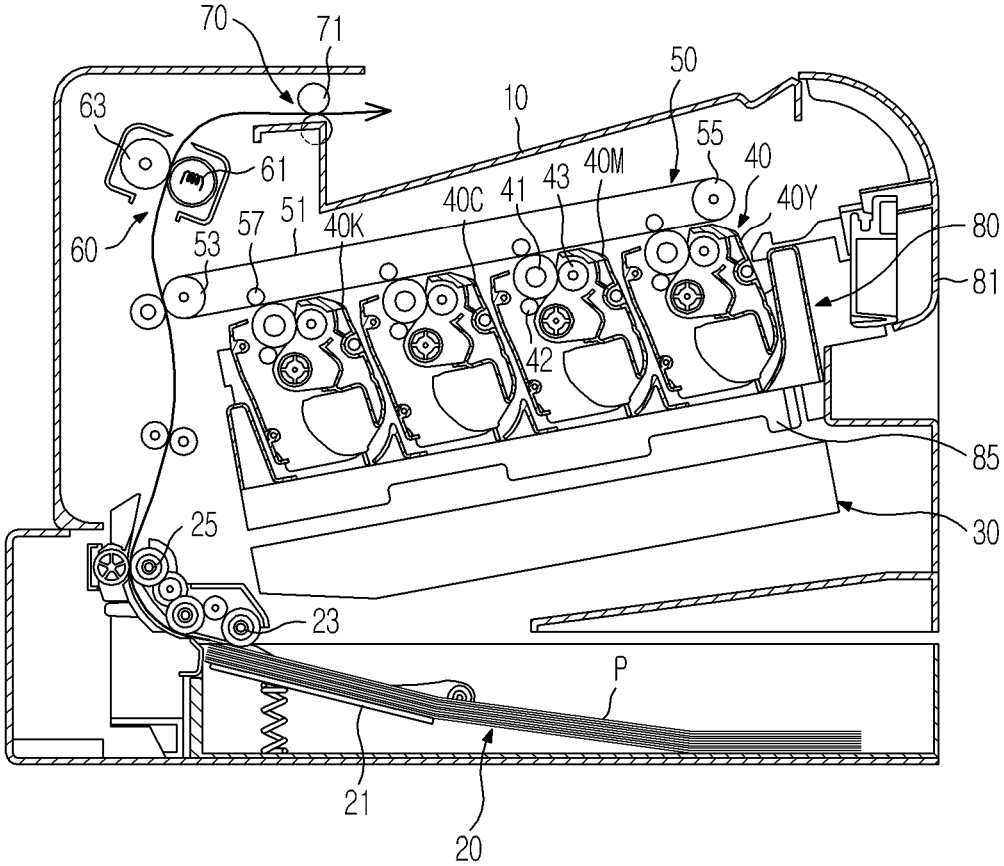
FIG. 1 is a sectional view schematically illustrating an image forming apparatus according to an exemplary embodiment of the present general inventive concept.

Reference will now be made in detail to the embodiment of the present general inventive concept, examples of which are illustrated in the accompanying drawings, wherein like reference numerals refer to like elements throughout. The embodiments are described below in order to explain the present general inventive concept by referring to the figures.

Figure 2:
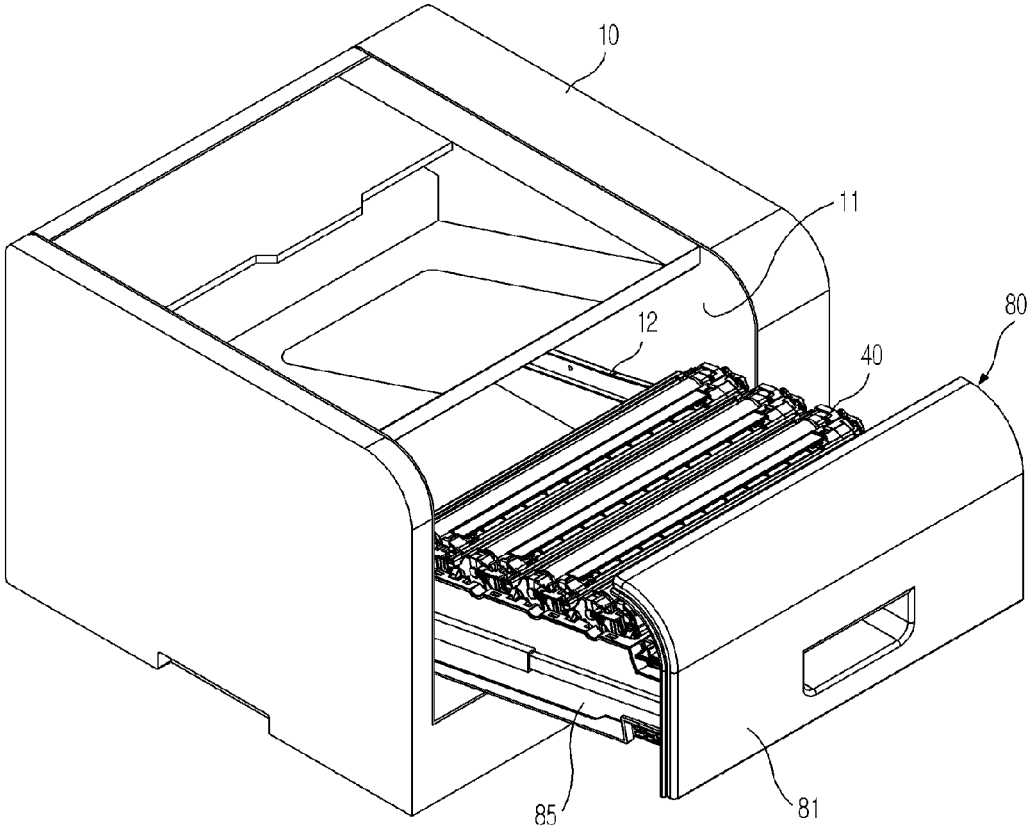
FIG. 2 is a perspective view illustrating an open state of a drawer provided in the image forming apparatus according to an exemplary embodiment of the present general inventive concept.

FIG. 1 is a sectional view schematically illustrating an image forming apparatus according to an exemplary embodiment of the present general inventive concept, and FIG. 2 is a perspective view illustrating an open state of a drawer provided in the image forming apparatus according to an exemplary embodiment of the present general inventive concept;

Referring to FIG. 1, the image forming apparatus may include a main body 10, a paper feeding unit 20, a light scanning unit 30, a developing unit 40, a transfer unit 50, a fusing unit 60, and a paper discharge unit 70.

The main body 10 defines an external appearance of the image forming apparatus and supports a variety of elements received therein.

The paper feeding unit 20 may include a cassette 21 in which printing media P are stored, a pickup roller 23 to pick up the printing media P stored in the cassette 21 one by one, and a delivery roller 25 to deliver each picked printing medium P toward the developing unit 40.

The developing unit 40 may be composed of four developing units 40Y, 40M, 40C and 40K, in which different colors of toners, for example, yellow (Y), magenta (M), cyan (C), and black (K) toners are received respectively.

Each of the developing units 40Y, 40M, 40C and 40K may include a photoconductor 41, on a surface of which an electrostatic latent image is formed by the light scanning unit 30, a charging roller 42 to charge the photoconductor 41, a developing roller 43 to supply toner to the electrostatic latent image formed on the photoconductor 41 so as to form a visible image, and a feed roller (not shown) to supply the Wrier to the developing roller 43.

The light scanning unit 30 irradiates light corresponding to yellow, magenta, cyan and black image signals to the photoconductors 41 of the respective developing units 40Y, 40M, 40C and 40K.

The transfer unit 50 may include a transfer belt 51 to perform circulation traveling in contact with the photoconductor 41 of each developing unit 40, a drive roller 53 to drive the transfer belt 51, a tension roller 55 to apply a constant tensile force to the transfer belt 51, and four rollers 57 to transfer a toner image developed on the photoconductor 41 of each developing unit 40 to the printing medium P.

The fusing unit 60 includes a heating roller 61 containing a heat source to heat the printing medium P to which the toner has been transferred, and a pressure roller 63 installed to face the heating roller 61 to maintain a constant fusing pressure between the heating roller 61 and the pressure roller 63.

The paper discharge unit 70 may include a plurality of discharge rollers 71 to discharge the printing medium P, on which the image has completely been formed, to the outside of the main body 10.

With the above-described configuration, as the printing medium P, picked up by the paper feeding unit 20, is delivered to the developing unit 40, a color image is transferred from the photoconductors 41 of the respective developing units 40 to the printing medium P. After the fusing unit 60 fuses the color image to the printing medium P, the paper discharge unit 70 discharges the printing medium P to the outside of the main body 10.

In the meantime, a drawer 80 may be installed to the main body 10 so as to be pushed into or pulled out of the main body 10 through one open side of the main body 10. The developing unit 40 may be mounted in the main body 10 while being received in the drawer 80. The drawer 80 may include a front cover 81 defining one sidewall of the main body 10, a tray 85 in which the developing unit 40 is received, and drive plates 120 (see FIG. 3) coupled to the front cover.

FIG. 2 illustrates an open state of the drawer provided in the image forming apparatus according to an exemplary embodiment of the present general inventive concept.

Referring to FIG. 2, the drawer 80 may include a front cover 81 defining one sidewall of the main body 10, a tray 85 in which the developing unit 40 is received, and drive plates 120 (see FIG. 3) coupled to the front cover. The tray 85 is slidable into or out of the main body 10 along sliding rails 12 attached to both inner sidewall surfaces 11 of the main body 10.

In a state in which the tray 85 is forwardly pulled out of the main body 10, the developing unit 40 received in the tray 85 may be exchanged. The exchanged developing unit 40 is inserted into the main body 10 using the tray 85.

In the image forming apparatus of the present exemplary embodiment, in linkage with a unique operation of opening or closing the drawer 80, i.e. as the drawer 80 is pushed into or pulled out of the main body 10, installation/separation and fixing/release of the developing unit 40 and connection/disconnection between the developing unit and electric contacts and a drive device may be accomplished.

Figure 3:
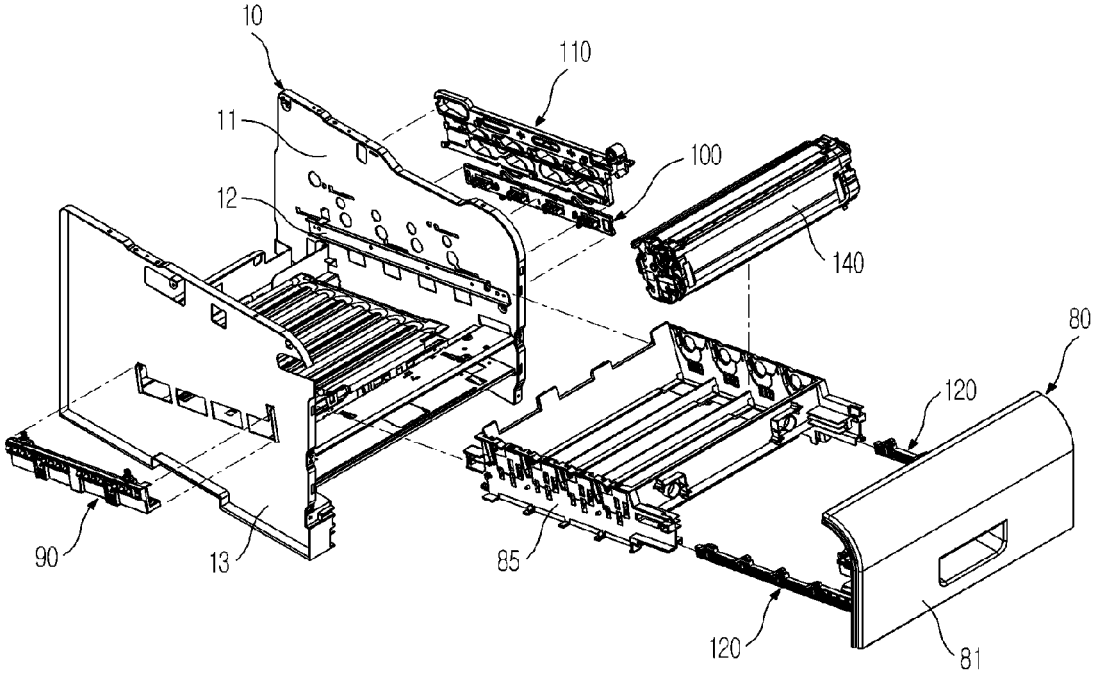
FIG. 3 is an exploded perspective view illustrating elements of the image forming apparatus according to an exemplary embodiment of the present general inventive concept.
Figure 4:
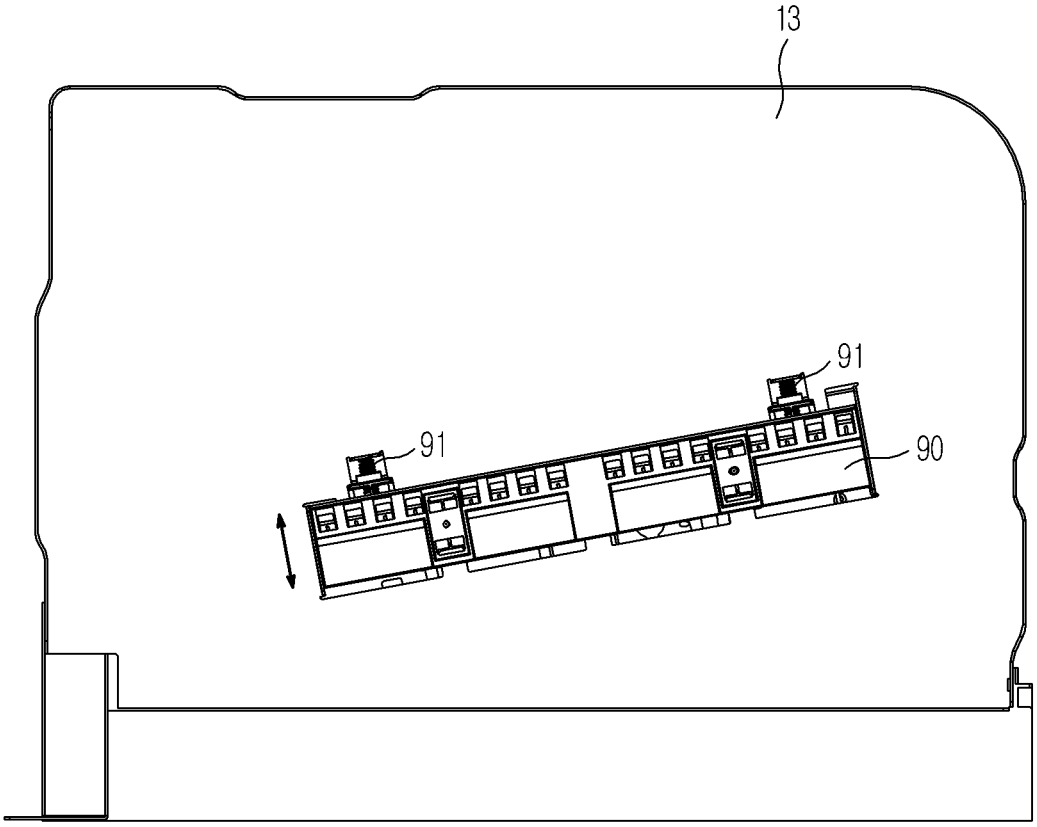
FIG. 4 is a sectional view illustrating elements arranged on one sidewall of a main body according to an exemplary embodiment of the present general inventive concept.
Figure 5:
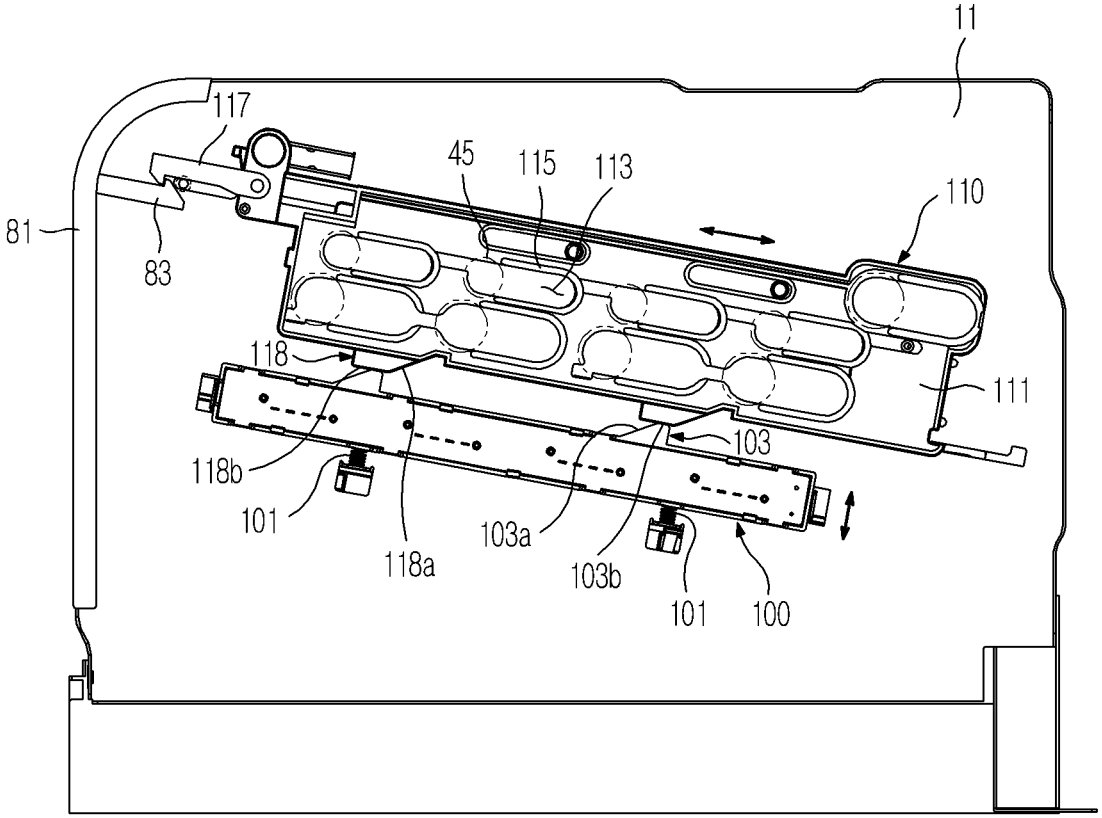
FIG. 5 is a sectional view illustrating elements arranged on an opposite sidewall of the main body according to an exemplary embodiment of the present general inventive concept.

FIG. 3 is an exploded perspective view illustrating elements of the image forming apparatus according to an exemplary embodiment of the present general inventive concept, FIG. 4 is a sectional view illustrating elements arranged on one sidewall of the main body according to an exemplary embodiment of the present general inventive concept, and FIG. 5 is a sectional view illustrating elements arranged on an opposite sidewall of the main body according to an exemplary embodiment of the present general inventive concept.

Referring to FIGS. 3 to 5, the image forming apparatus may include a high-voltage connector 90 to apply high-voltage current to the developing unit 40, a Customer Replaceable Unit Module (CRUM) connector 100 to transmit developing information to the developing unit 40, and a coupling connector 110 to connect or disconnect a coupling 45 (see FIG. 5) that serves to transmit power to the rollers of the developing unit 40.

The image forming apparatus may further include drive plates 120, which are coupled at one end to the front cover 81 and perform reciprocating motion beneath the tray and serve to vertically move the developing unit 40 received in the tray 85 in linkage with movement of the front cover 81.

The high-voltage connector 90 is supported on one sidewall 13 of the main body 10 via elastic members 91 such that the high-voltage connector 90 can move vertically. The elastic members 91 apply elastic force in a direction in which the high-voltage connector 90 is moved downward.

The high-voltage connector 90 includes terminals (not shown) connected to electric contacts of the developing unit 40. The terminals of the high-voltage connector 90 are brought into contact with or are released from contact terminals (not shown) of the tray 85, thereby controlling supply of power to the developing unit 40.

The coupling connector 110 and the CRUM connector 100 may be arranged on an opposite sidewall 11 of the main body 10. The coupling connector 110 may include a coupling rack 111, which is installed to the sidewall 11 of the main body 10 in a forwardly or rearwardly slidable manner.

The coupling rack 111 may have a coupling slot 113 to guide movement of the coupling 45 so as to control transmission of power to the developing unit 40. The coupling slot 113 may be provided at an outer circumference thereof with an inclined guide 115 to enable forward or rearward movement of the coupling 45 such that the coupling 45 is connected to or disconnected from the rollers of the developing unit 40 when the coupling rack 111 is moved forward or rearward. The inclined guide 115 may be inclined upward toward the rear of the main body 11.

A coupling lever 117 may be provided at a front upper end of the coupling rack 111 so as to be selectively hooked with or released from the front cover 81 by way of an operating hook 83 disposed on the front cover 81. Operation of the coupling lever 117 will be further described later.

The CRUM connector 100 serves to connect a Customer Replaceable Unit Module (CRUM), which is installed in the developing unit 40 to store, e.g., lifespan and identification information of the developing unit 40, to a main board (not shown) mounted in the main body 10. The CRUM connector 100 is located beneath the coupling rack 111 while being supported on the sidewall 11 of the main body 10 via elastic members 101 such that the CRUM connector 100 can move vertically.

To allow the CRUM connector 100 to be movable upward and downward in linkage with movement of the coupling rack 111, the CRUM connector 100 may be provided at an upper end thereof with at least one upwardly-protruding first guide rib 103, and the coupling rack 111 may be provided at a lower end thereof with a downwardly-protruding second guide rib 118 to correspond to the first guide rib 103.

The first guide rib 103 may have an upwardly-inclined first slope 103*a* and a first horizontal plane 103*b*, and the second guide rib 118 may have a downwardly-inclined second slope 118*a* and a second horizontal plane 118*b*.

When the coupling rack 111 reciprocates forward and rearward, the second guide rib 118 is slidably moved in a surface contact with the first guide rib 103. In a state in which the first horizontal plane 103*b* and the second horizontal plane 118*b* come into contact with each other, the coupling rack 111 pushes the CRUM connector 100 downward to enable connection of electric contacts of the CRUM connector 100 to the main board. Also, in a state in which the first slope 103*a* and the second slope 118*a* come into contact with each other, the CRUM connector 100 is movable upward by elasticity of the elastic members 101, causing disconnection of the electric contacts of the CRUM connector 100 from the main board.

Figure 6:
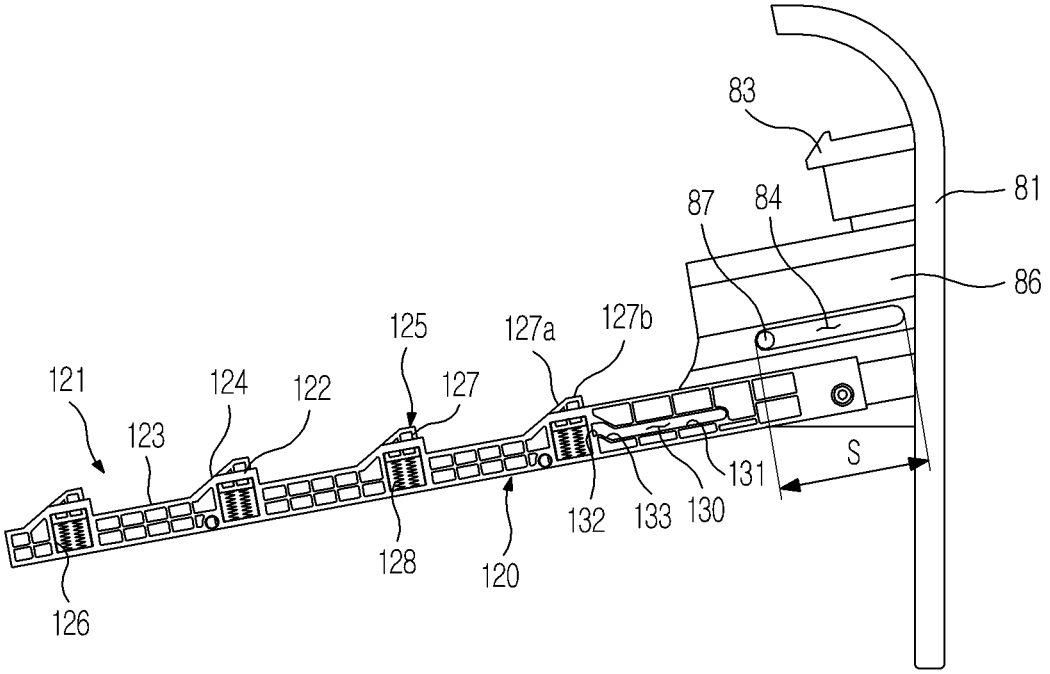
FIG. 6 is a sectional view illustrating a drive plate according to an exemplary embodiment of the present general inventive concept.

FIG. 6 is a sectional view illustrating the drive plate according to an exemplary embodiment of the present general inventive concept.

Referring to FIGS. 3 and 6, each drive plate 120 takes the form of a bar extending rearward from a rear surface of the front cover 81 so as to be moved along with the front cover 81.

The pair of drive plates 120 is provided at opposite sides of the rear surface of the front cover 81 such that opposite ends of the developing unit 40 are supported respectively on upper ends of the drive plates 120.

The drive plates 120 are moved along with the front cover 81. Thereby, the developing unit 40 supported on the upper ends of the drive plates 120 may be moved upward and downward according to movement of the drive plates 120 between a first position where the photoconductor 41 of the developing unit 40 comes into contact with the transfer unit 50 and a second position where the photoconductor 41 of the developing unit 40 is spaced apart from the transfer unit 50.

To this end, each of the drive plates 120 is provided at the upper end thereof with at least one position guide portion 121 to move the developing unit 40 upward and downward. The position guide portion 121 includes a position raising portion 122 to keep the developing unit 40 at the first position, a position lowering portion 123 located lower than the position raising portion 122 to keep the developing unit 40 at the second position, and an inclined guiding portion 124 connecting the position raising portion 122 and the position lowering portion 123 to each other.

The position raising portion 122 and the position lowering portion 123 are located at different heights and the developing unit 40 is easily movable on the inclined guiding portion 124 between the position raising portion 122 and the position lowering portion 123.

A pressure unit 125 may be provided on the position raising portion 122 and serve to elastically push the developing unit 40 toward the transfer unit 50 when the developing unit 40 is located on the position raising portion 122.

The pressure unit 125 may include a lifting member 127, which is vertically movable in a receiving recess 126 of the drive plate 120, and a pressure spring 128 placed beneath the lifting member 127 to apply elastic force to the lifting member 127 so as to move the lifting member 127 upward.

The lifting member 127 may have a lifting member slope 127*a*, which corresponds to the inclined guiding portion 124 to guide the developing unit 40 to the position lowering portion 123, and a developing unit pressure surface 127*b*, which comes into contact with the lower end of the developing unit 40 to apply pressure to the developing unit 40.

The drive plate 120 may be further provided at a side surface thereof with a stepped horizontal guide groove 130.

The guide groove 130 may be composed of a lower first guide groove 131, an upper second guide groove 132, and an inclined groove 133 connecting the first guide groove 131 and the second guide groove 132 to each other.

The guide groove 130 functions to assist locking or unlocking of a binding unit which is used to restrict movement of the tray 85 in a predetermined section as will be described later. The guide groove 130 will be described in detail later.

The front cover 81 may be provided at the rear surface thereof with a rearwardly-extending coupling operating hook 83 to be selectively hooked with the above-described coupling lever 117.

In addition, a frame 86 may protrude rearward from the rear surface of the front cover 81. The frame 86 may have a slot 84 to enable movement of the front cover 81 independently of the tray 85 when attempting to pull the front cover 81 out of the main body 10.

The slot 84 is elongated in a longitudinal direction of the frame 86 and a retainer boss 87 is inserted in the slot 84. The slot 84 has a predetermined length equal to an operating section S in which the front cover 81 is moved independently of the tray 85 when being pulled out of the main body 10.

The retainer boss 87 is provided at the tray 85. The front cover 81 is moved independently of the tray 85 until the retainer boss 87 is caught by an end of the slot 84.

Figure 7:
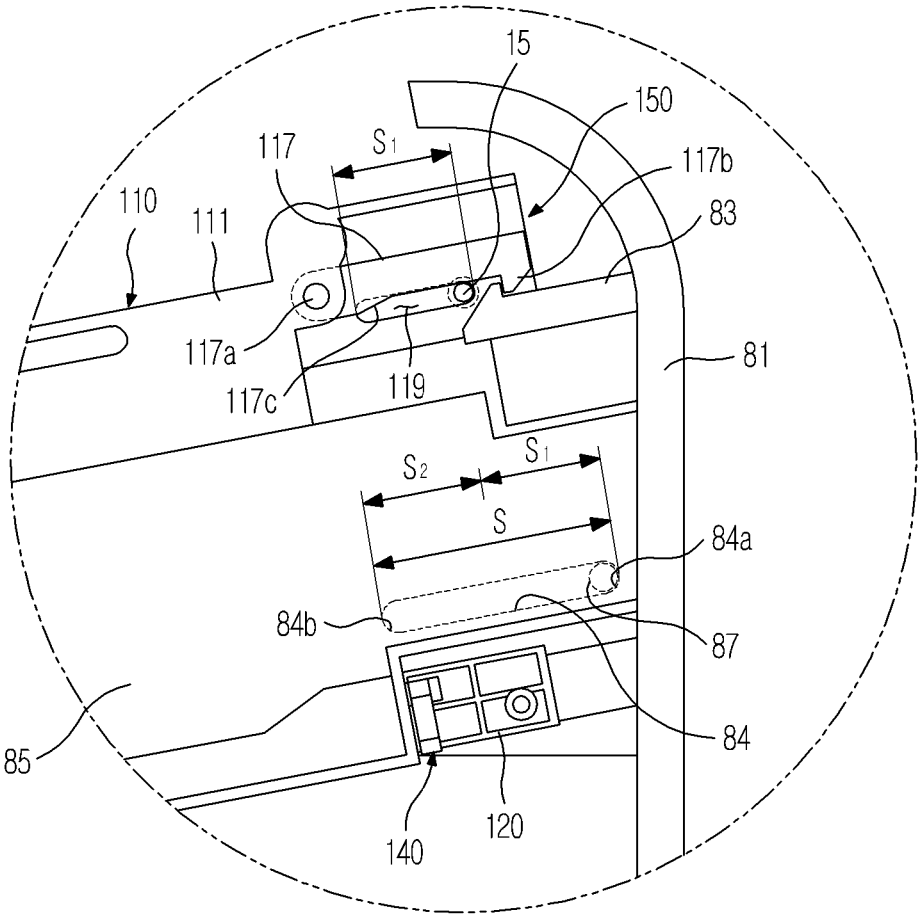
FIG. 7 is a view illustrating a coupling relationship between a tray and a front cover when the front cover is pushed into the main body according to an exemplary embodiment of the present general inventive concept.
Figure 8:
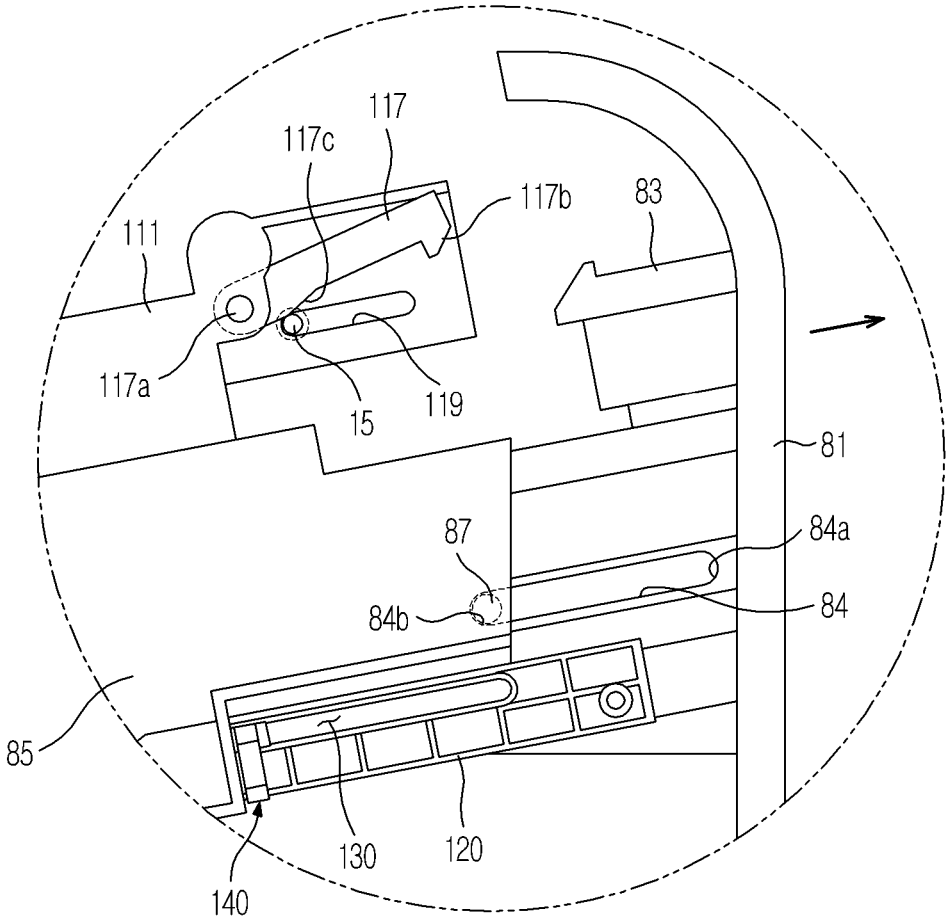
FIG. 8 is a view illustrating a coupling relationship between the tray and the front cover when the front cover is pulled out of the main body by an operating section according to an exemplary embodiment of the present general inventive concept.

FIG. 7 is a view illustrating a coupling relationship between the tray and the front cover when the front cover is pushed into the main body according to an exemplary embodiment of the present general inventive concept, and FIG. 8 is a view illustrating a coupling relationship between the tray and the front cover when the front cover is pulled out of the main body in the operating section according to an exemplary embodiment of the present general inventive concept.

Referring to FIG. 7, the slot 84 has a first end 84*a* and a second end 84*b*. In a state in which the front cover 81 is pushed into the main body 10, the retainer boss 87 of the tray 85 is located at the first end 84*a* of the slot 84.

Thereafter, if the front cover 81 is pulled forward so as to be pulled out of the main body 10 as illustrated in FIG. 8, the retainer boss 87 of the tray 85 is moved along the slot 84. Thus, the tray 85 and the front cover 81 do not constrain each other, which allows only the front cover 81 to be pulled forward.

Hereinafter, the portion of distance in which the front cover 81 is movable independently of the tray 85 is referred to as the operating section S. In the present embodiment, the operating section S will be described as 40 mm by way of example.

The operating section S includes a first section $S_1$ in which the first cover 81 is initially pulled forward, and a second section $S_2$ in which the first cover 81 is further pulled forward. The first section $S_1$ and the second section $S_2$ will be described as 20 mm respectively by way of example.

The tray 85 may be kept stationary so as not to be moved while the front cover 81 is pulled out of the main body 10 by the operating section S. To this end, a tray binding unit 140 (hereinafter, referred to as a second binding unit) may be provided between the tray 85 and the drive plate 120 to bind the tray 85 while the front cover 81 is moved by the operating section S and unbind the tray 85 after the front cover 81 passes the operating section S. The tray binding unit 140 will be described hereinafter in detail.

In addition, a coupling connector binding unit 150 (hereinafter, referred to as a first binding unit) may be provided to selectively bind the coupling rack 111 to the front cover 81. Specifically, the coupling connector binding unit 150 binds the coupling rack 111 to the front cover 81 while the front cover 81 is moved by the first section $S_1$ such that the coupling rack 111 is moved along with the front cover 81, but unbinds the coupling rack 111 from the front cover 81 while the front cover 81 is moved in the second section $S_2$.

The first binding unit 150 may include the coupling lever 117. The coupling lever 117 is coupled to a front end of the coupling rack 111 so as to be rotatable about a rotating shaft 117*a*. As the coupling lever 117 rotates about the rotating shaft 117*a*, the coupling lever 117 is hooked with the operating hook 83 protruding from the rear surface of the front cover 81.

The coupling lever 117 is provided at a tip end thereof with a hook portion 117*b* and a lower surface of the coupling lever 117 is supported on a stud member 15 fixed to the sidewall 11 of the main body 10.

The stud member 15 is movably inserted in a stud slot 119 of the coupling rack 111.

The coupling lever 117 is provided at a lower end position near the rotating shaft 117*a* with a downwardly-inclined slope 117*c*. When the slope 117*c* of the coupling lever 117 is moved in contact with the stud member 15, the coupling lever 117 is pivotally rotated upward, thereby being released from the operating hook 83.

The stud slot 119 may have a length corresponding to that of the first section $S_1$.

Hereinafter, the second binding unit 140 will be described.

Figure 9:
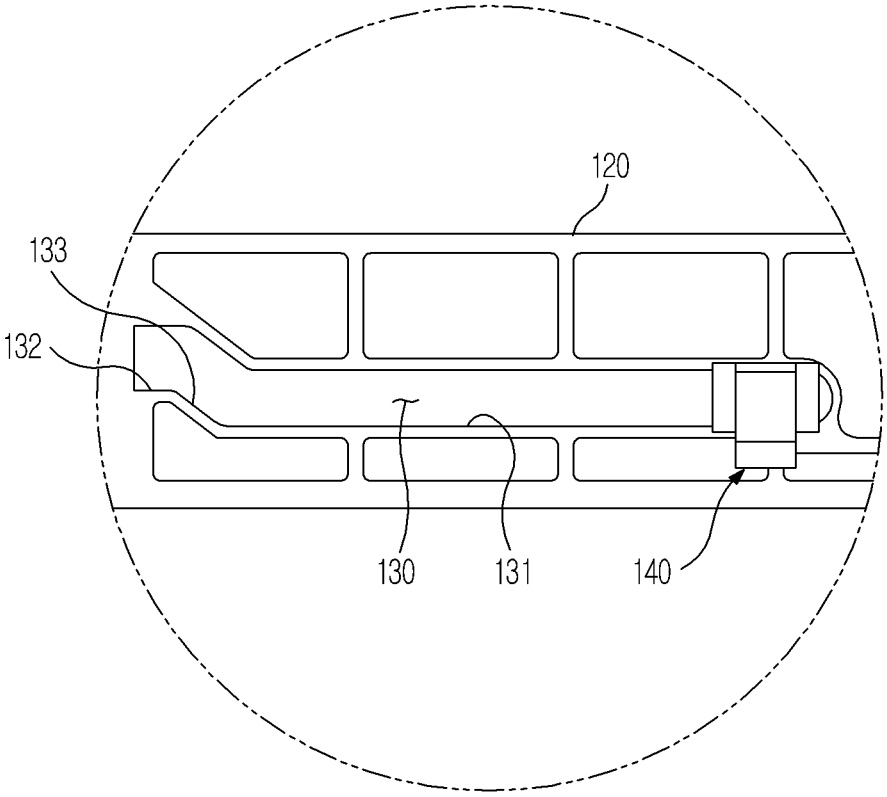
FIGS. 9 and 10 are views illustrating a locked state of a second binding unit according to an exemplary embodiment of the present general inventive concept.
Figure 10:
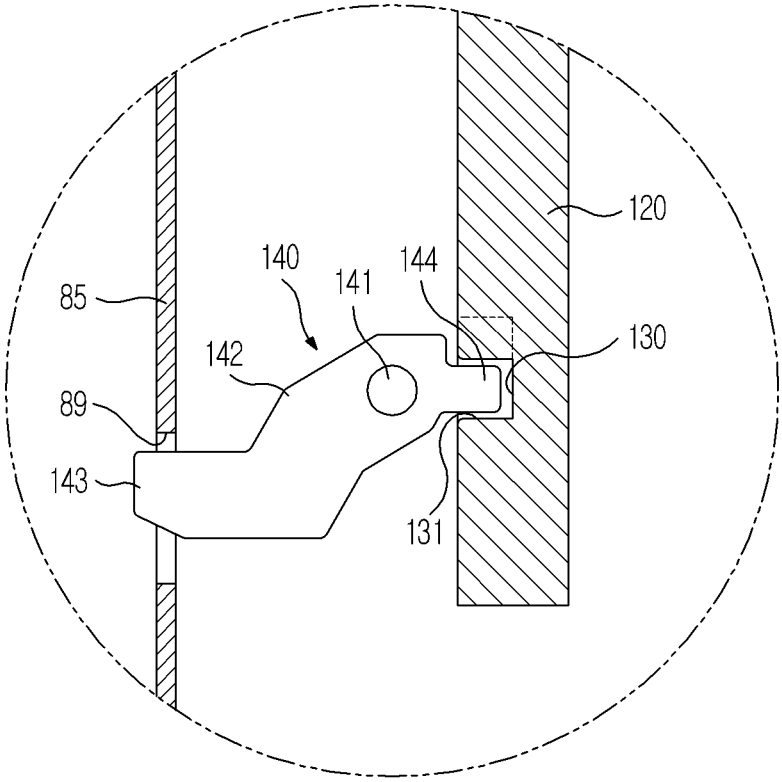
Figure 11:
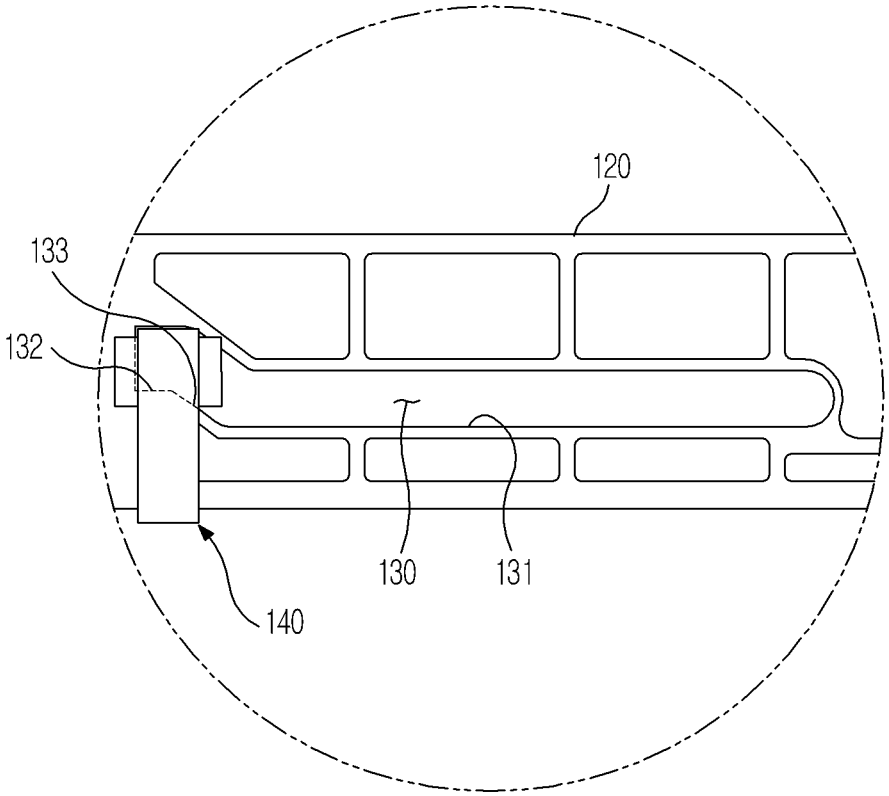
FIGS. 11 and 12 are views illustrating an unlocked state of the second binding unit according to an exemplary embodiment of the present general inventive concept.
Figure 12:
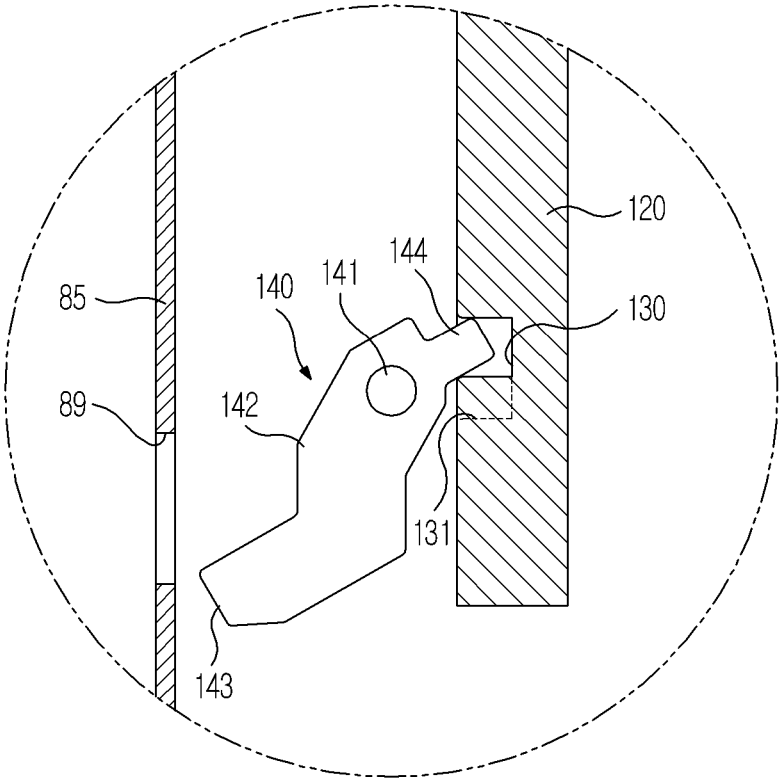

FIGS. 9 and 10 are views illustrating a locked state of the second binding unit according to an exemplary embodiment of the present general inventive concept, and FIGS. 11 and 12 are views illustrating an unlocked state of the second binding unit according to an exemplary embodiment of the present general inventive concept.

Referring to FIGS. 9 to 12, the second binding unit 140 may include a lock-up member 142, which is arranged between the tray 85 and the drive plate 120 so as to be rotatable about a rotating shaft 141, a trap hole 89 formed in the tray 85, and the guide groove 130 formed in the drive plate 120.

The lock-up member 142 may include a locking portion 143, which extends from one side of the rotating shaft 141 to the trap hole 89 so as to be caught by the trap hole 89, and a guide protrusion 144, which extends from the other side of the rotating shaft 141 to the guide groove 130 of the drive plate 120 so as to be moved along the guide groove 130.

The guide groove 130, as described above, includes the lower first guide groove 131 having a length corresponding to that of the operating section S, the upper second guide groove 132, and the inclined groove 133 between the first guide groove 131 and the second guide groove 132.

When the guide protrusion 144 of the lock-up member 142 is moved along the first guide groove 131, the locking portion 143 of the lock-up member 142 is caught and supported by the tray 85, preventing movement of the tray 85.

Thereafter, when the drive plate 120 is pulled out forward beyond the operating section S along with the front cover 81, as illustrated in FIG. 11, the guide protrusion 144 of the lock-up member 142 is moved along the inclined groove 133. Thereby, the locking portion 143 of the lock-up member 142, as illustrated in FIG. 12, is rotated downward about the rotating shaft 141, thereby being released from the trap portion 89 of the tray 85.

Hereinafter, operation in relation to the operating section S in which the front cover 81 is pulled out of the main body 10 will be described.

Figure 13:
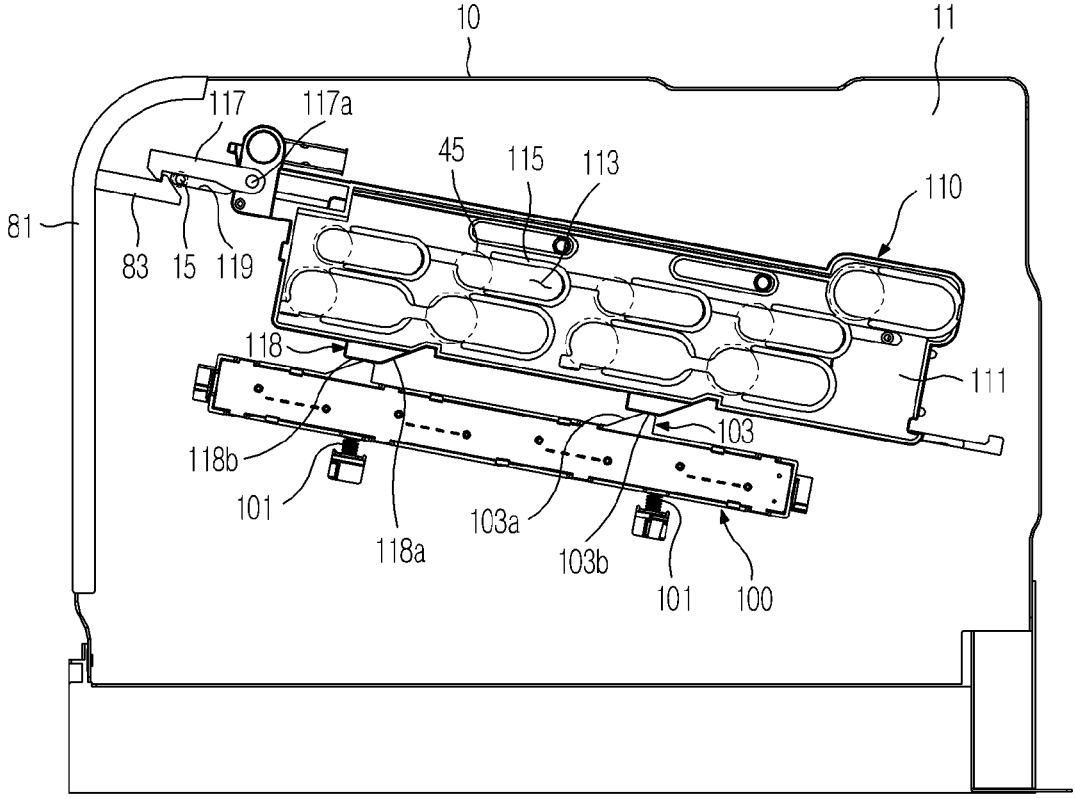
FIG. 13 is a view illustrating a coupling relationship between a coupling connector and a CRUM connector when the front cover is pushed in according to an exemplary embodiment of the present general inventive concept.
Figure 14:
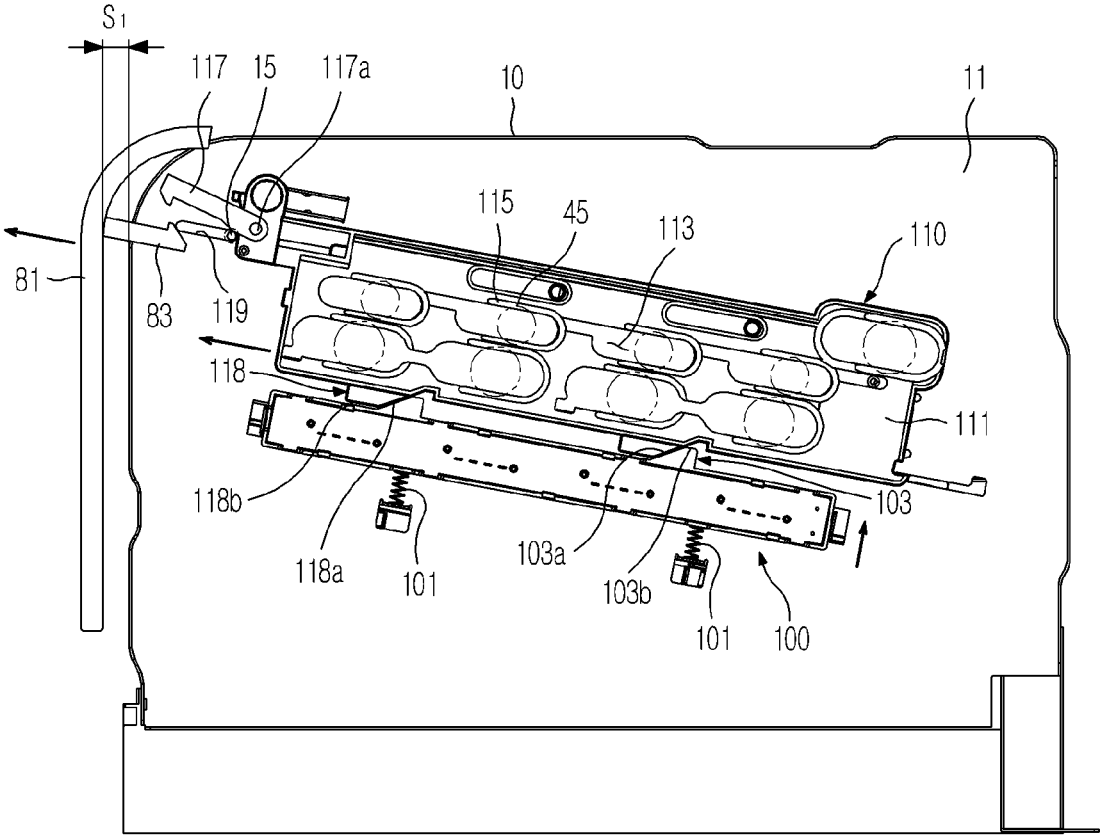
FIG. 14 is a view illustrating a coupling relationship between the coupling connector and the CRUM connector when the front cover is pulled out of the main body by a first section according to an exemplary embodiment of the present general inventive concept.
Figure 15:
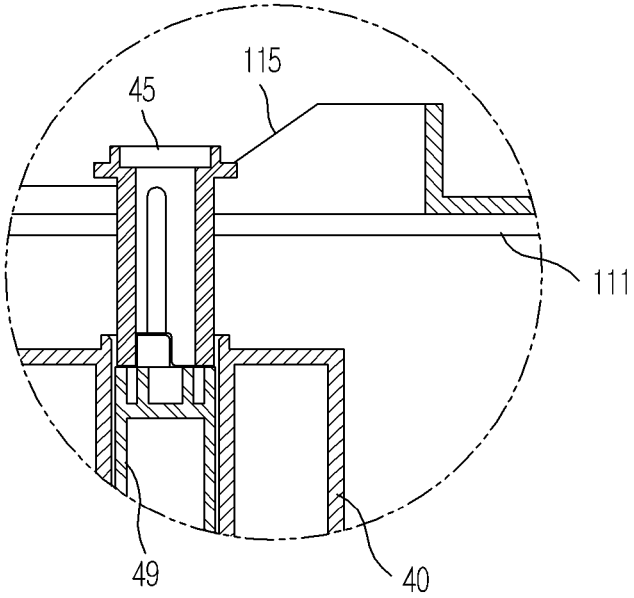
FIG. 15 is a view illustrating a coupling relationship of a coupling in a state of FIG. 13.
Figure 16:
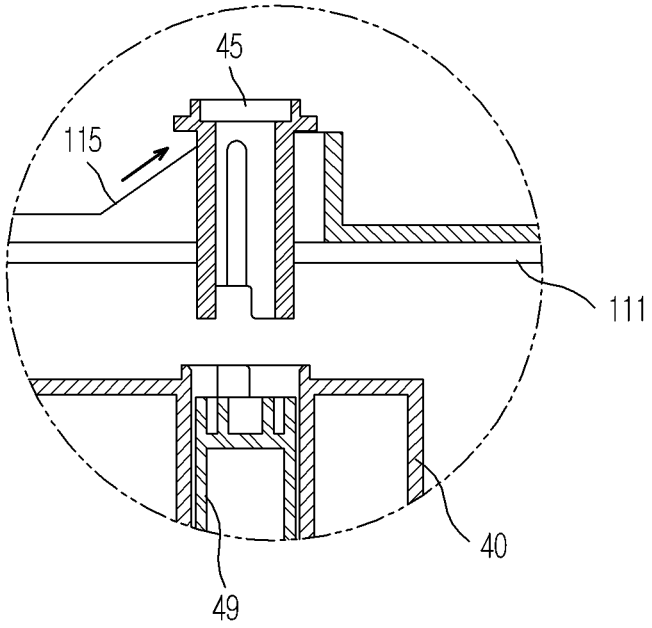
FIG. 16 is a view illustrating a coupling relationship of the coupling in a state of FIG. 14.

FIG. 13 is a view illustrating a coupling relationship between the coupling connector and the CRUM connector when the front cover is pushed in according to an exemplary embodiment of the present general inventive concept, FIG. 14 is a view illustrating a coupling relationship between the coupling connector and the CRUM connector when the front cover is pulled out of the main body by a first section according to an exemplary embodiment of the present general inventive concept, FIG. 15 is a view illustrating a coupling relationship of the coupling in a state of FIG. 13, and FIG. 16 is a view illustrating a coupling relationship of the coupling in a state of FIG. 14.

In a state in which the front cover 81 is inserted in the main body 10 as illustrated in FIG. 13, the coupling 45 provided at the coupling connector 110 comes into contact with the roller 49 of the developing unit 40 as illustrated in FIG. 15.

In this case, the CRUM connector 100 is downwardly pushed by the coupling rack 111 and is electrically connected to the tray 85.

Thereafter, when the front cover 81 is pulled out of the main body 10, the coupling lever 117 provided at the front end of the coupling rack 111 is hooked with the coupling operating hook 83 provided at the rear surface of the front cover 81, thereby allowing the coupling rack 111 to be pulled out forward along with the front cover 81.

In this case, the front cover 81 is moved independently of the tray 85 as illustrated in FIG. 7. After the front cover 81 is pulled out of the main body 10 by the first section $S_1$, as illustrated in FIG. 14, the coupling lever 117 is rotated upward by the stud member 15, thereby being released from the coupling operating hook 83.

The coupling 45 is moved along the coupling slot 113 and simultaneously, is released from the roller 49 of the developing unit 40 by the inclined guide 115 as illustrated in FIG. 16.

Additionally, if the coupling rack 111 is moved forward, pressure applied to the CRUM connector 100 is removed, causing the CRUM connector 100 to be moved upward by elasticity of the elastic members 101, which results in disconnection of the electric contacts between the CRUM connector 100 and the tray 85.

Hereinafter, operation of the developing unit when the front cover is pulled out according to an exemplary embodiment of the present general inventive concept will be described.

Figure 17:
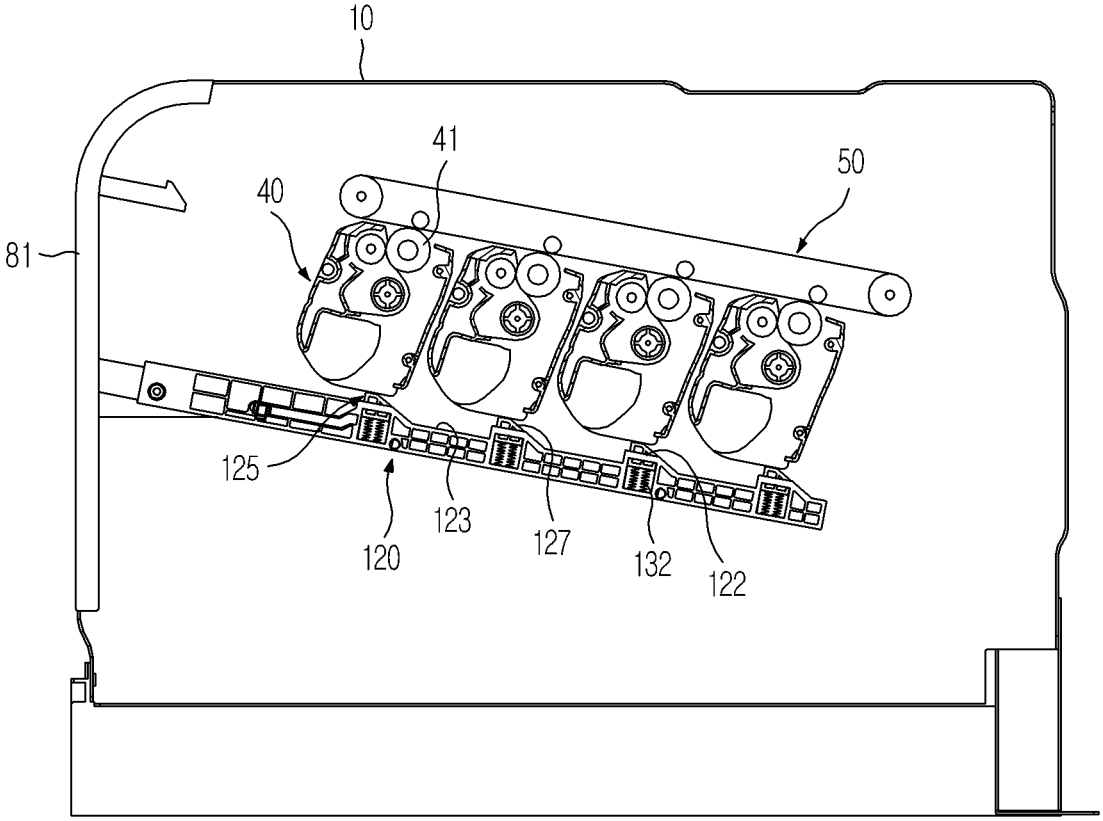
FIG. 17 is a view illustrating a coupling relationship between the developing unit and the drive plate when the front cover is pushed into the main body according to an exemplary embodiment of the present general inventive concept.
Figure 18:
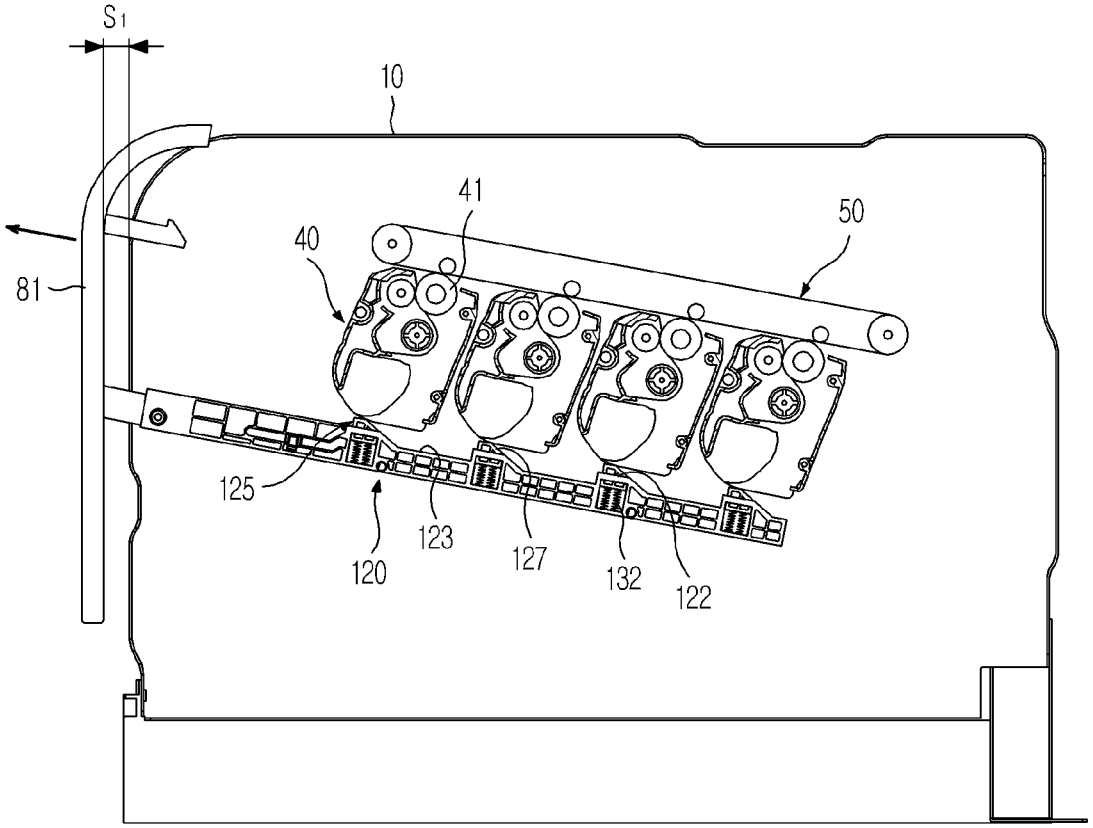
FIG. 18 is a view illustrating a coupling relationship between the developing unit and the drive plate when the front cover is pulled out of the main body by the first section according to an exemplary embodiment of the present general inventive concept.
Figure 19:
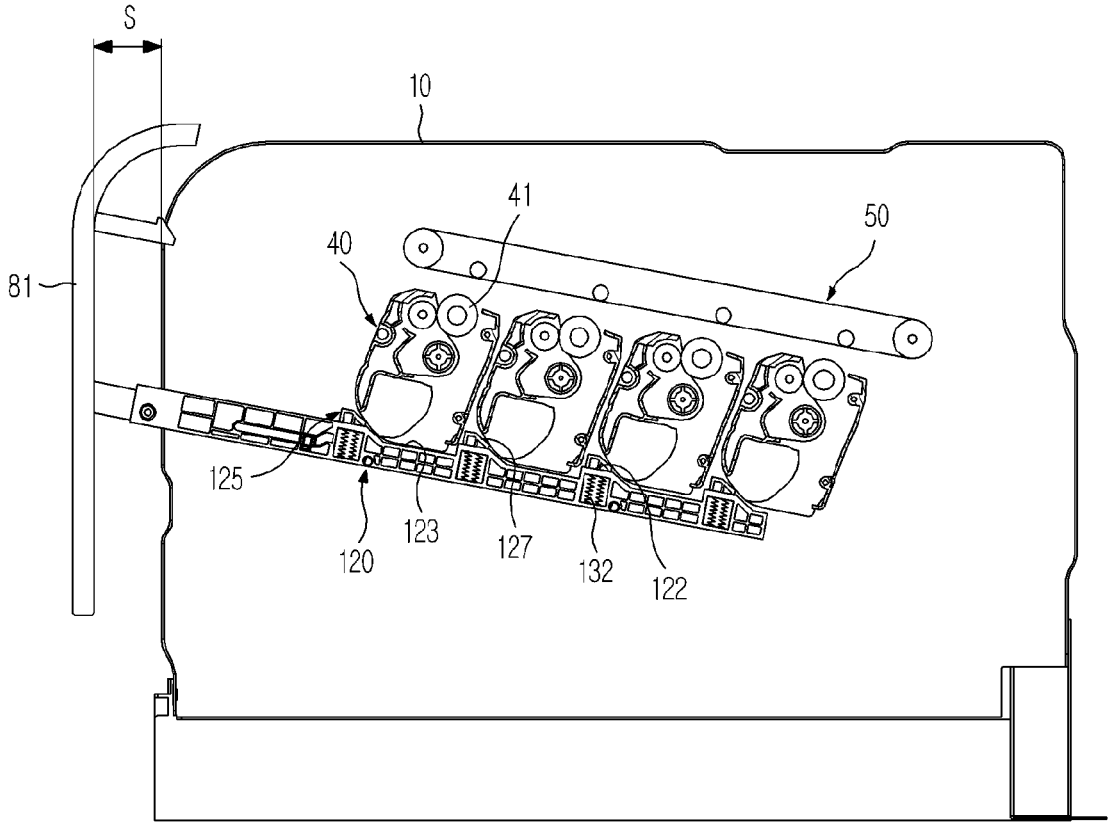
FIG. 19 is a view illustrating a coupling relationship between the developing unit and the drive plate when the front cover is further pulled out of the main body by a second section according to an exemplary embodiment of the present general inventive concept.

FIG. 17 is a view illustrating a coupling relationship between the developing unit and the drive plate when the front cover is pushed into the main body according to an exemplary embodiment of the present general inventive concept, FIG. 18 is a view illustrating a coupling relationship between the developing unit and the drive plate when the front cover is pulled out of the main body by the first section according to an exemplary embodiment of the present general inventive concept, and FIG. 19 is a view illustrating a coupling relationship between the developing unit and the drive plate when the front cover is pulled out of the main body by the second section according to an exemplary embodiment of the present general inventive concept.

As illustrated in FIG. 17, in a state in which the front cover 81 is inserted in the main body 10, the developing unit 40 is arranged on the position raising portion 122 of the drive plate 120 and is supported at the lower surface thereof by the pressure unit 125, thereby being kept at a first position to come into contact with the transfer unit 50.

Thereafter, as illustrated in FIG. 18, if the front cover 81 is forwardly pulled out of the main body 10 by the first section $S_1$, the drive plate 120 coupled with the front cover 81 is moved forwardly by the first section $S_1$.

In this case, the lower end of the developing unit 40 is supported by the pressure unit 125 and as described above, the coupling 45 and the CRUM connector 100 are disconnected from the developing unit 40 (see FIG. 14).

Thereafter, as illustrated in FIG. 19, if the front cover 81 is moved forwardly from the main body 10 by the operating section S, the developing unit 40 is moved downward onto the position lowering portion 123 under guidance of the lifting member 127, thereby being moved to the second position where the developing unit 40 is spaced apart from the transfer unit 50. Thereby, the developing unit 40 remains completely detachable from the main body 10.

In this case, as illustrated in FIGS. 11 and 12, the lock-up member 142 is released from the tray 85 via rotation thereof.

Thereafter, if the front cover 81 is further pulled forwardly, illustrated in FIG. 8, the retainer boss 87 of the tray 85 is caught and supported by the second end 84*b* of the slot 84, causing the tray 85 to be pulled out of the main body 10 in a direction in which the front cover 81 is pulled out.

In the meantime, when the tray 85 is forwardly pulled out of the main body 10, the high-voltage connector 90 to apply high-voltage current to the developing unit 40 is disconnected in linkage with movement of the tray 85.

Hereinafter, a coupling relationship between the tray and the high-voltage connector according to an exemplary embodiment of the present general inventive concept will be described.

Figure 20:
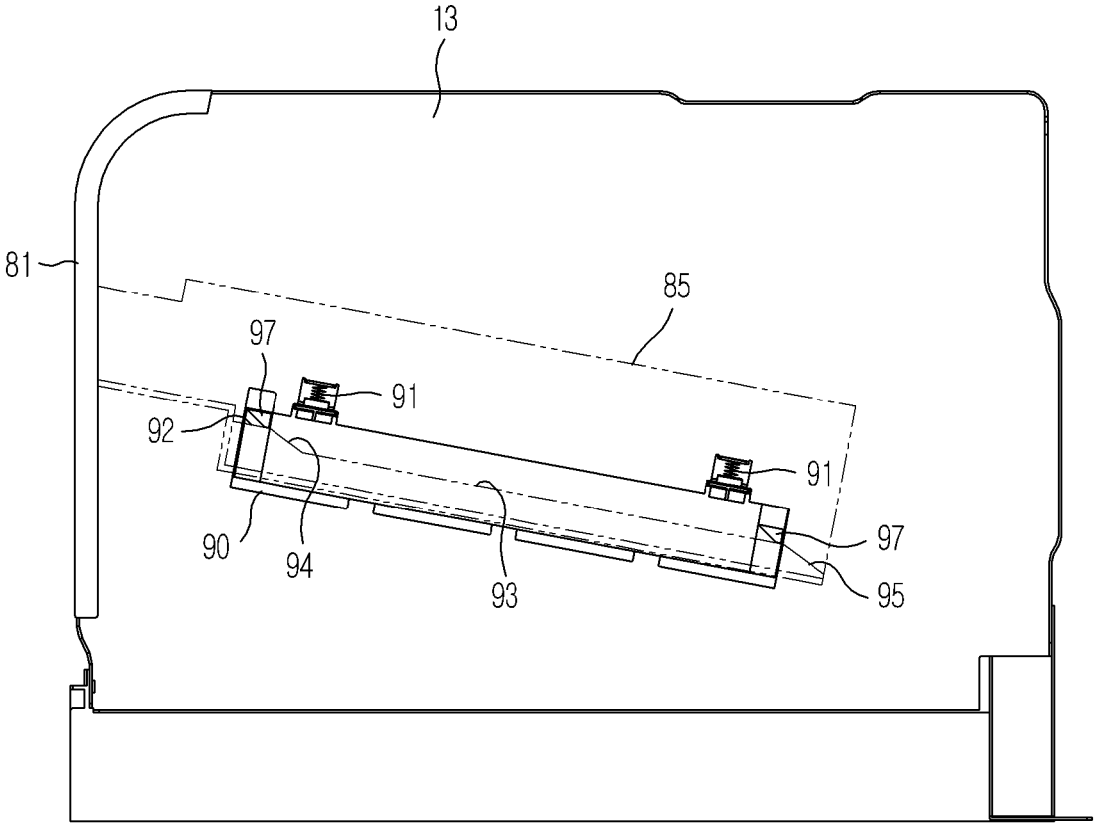
FIG. 20 is a view illustrating a coupling relationship between the tray and a high-voltage connector when the tray is pushed in according to an exemplary embodiment of the present general inventive concept.
Figure 21:
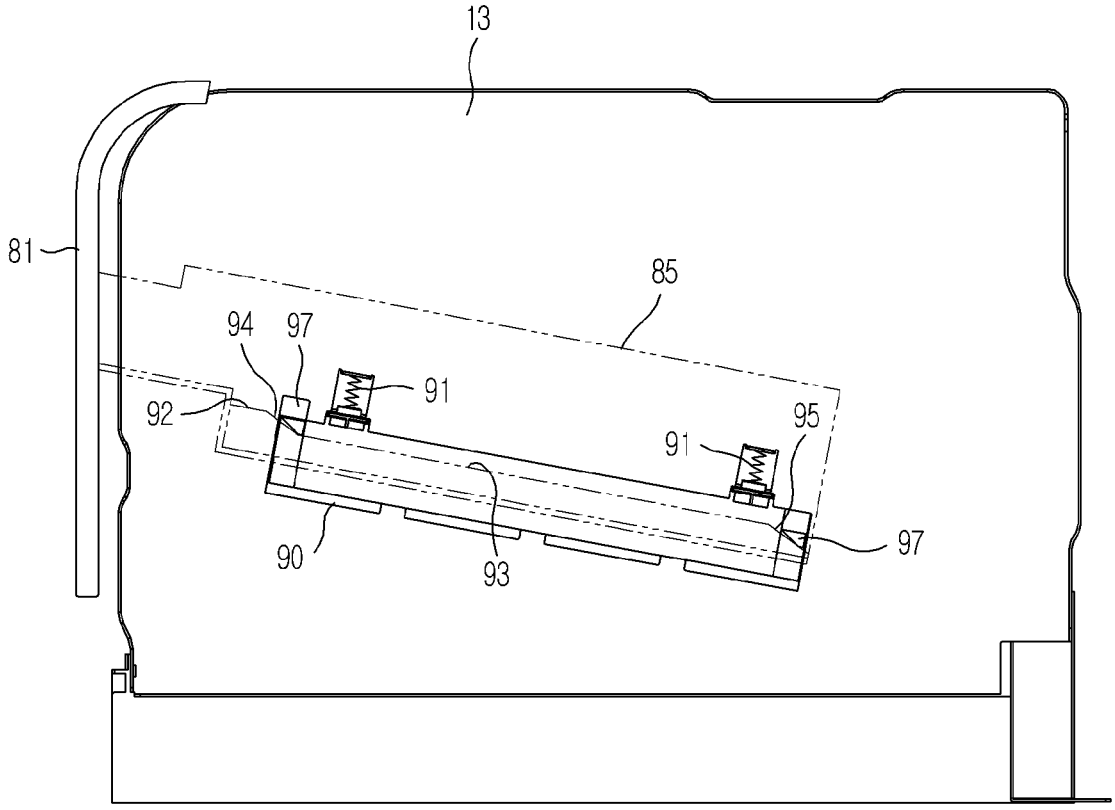
FIG. 21 is a view illustrating a coupling relationship between the tray and the high-voltage connector when the tray is pulled out according to an exemplary embodiment of the present general inventive concept.

FIG. 20 is a view illustrating a coupling relationship between the tray and the high-voltage connector when the tray is pushed into the main body according to an exemplary embodiment of the present general inventive concept, and FIG. 21 is a view illustrating a coupling relationship between the tray and the high-voltage connector when the tray is pulled out of the main body according to an exemplary embodiment of the present general inventive concept.

Referring to FIGS. 20 and 21, the tray 85 may be provided at a side surface thereof with lifting guides 92, 93, 94 and 95, which extend outward from the side surface of the tray 85 to move the high-voltage connector 90 upward and downward. The high-voltage connector 90 may be provided with pressure protrusions 97, which are slidable in surface contact with the lifting guides 92, 93, 94 and 95.

The lifting guides 92, 93, 94 and 95 may include stepped pressure planes 92 and 93 and separation guide slopes 94 and 95.

In a state in which the tray 85 is inserted in the main body 10, the high-voltage connector 90 is pushed upward by the pressure planes 92 and 93 of the lifting guides, such that electric contacts of the high-voltage connector 90 are connected to the terminals of the tray 85.

Thereafter, as described above, if the front cover 81 is forwardly pulled out of the main body 10 beyond the operating section S, the tray 85 is forwardly pulled out along with the front cover 81.

In this case, as illustrated in FIG. 21, as the pressure protrusions 97 slide on the separation guide slopes 94 and 95, pressure is no longer applied to the high-voltage connector 90, causing the high-voltage connector 90 to be moved downward by elasticity of the elastic members 91.

Thereby, the electric connection between the tray 85 and the high-voltage connector 90 is broken.

Thereafter, the front cover 81 and the tray 85, as illustrated in FIG. 2, are moved to a position where the developing unit 40 is dischargeable.

The scope of the present exemplary embodiment is not limited to the above description, and may include the following exemplary embodiment.

Although the above-described exemplary embodiment describes the operating section S in which the front cover 81 is moved independently of the tray 85 and the coupling connector 100 and the drive plate 120 as being moved in linkage with movement of the tray 85 in the operating section S, a grip may be provided at the tray 85 such that the coupling connector 110 and the drive plate 120 are moved linearly by rotating the grip so as to realize the above-described operation.

Figure 22:
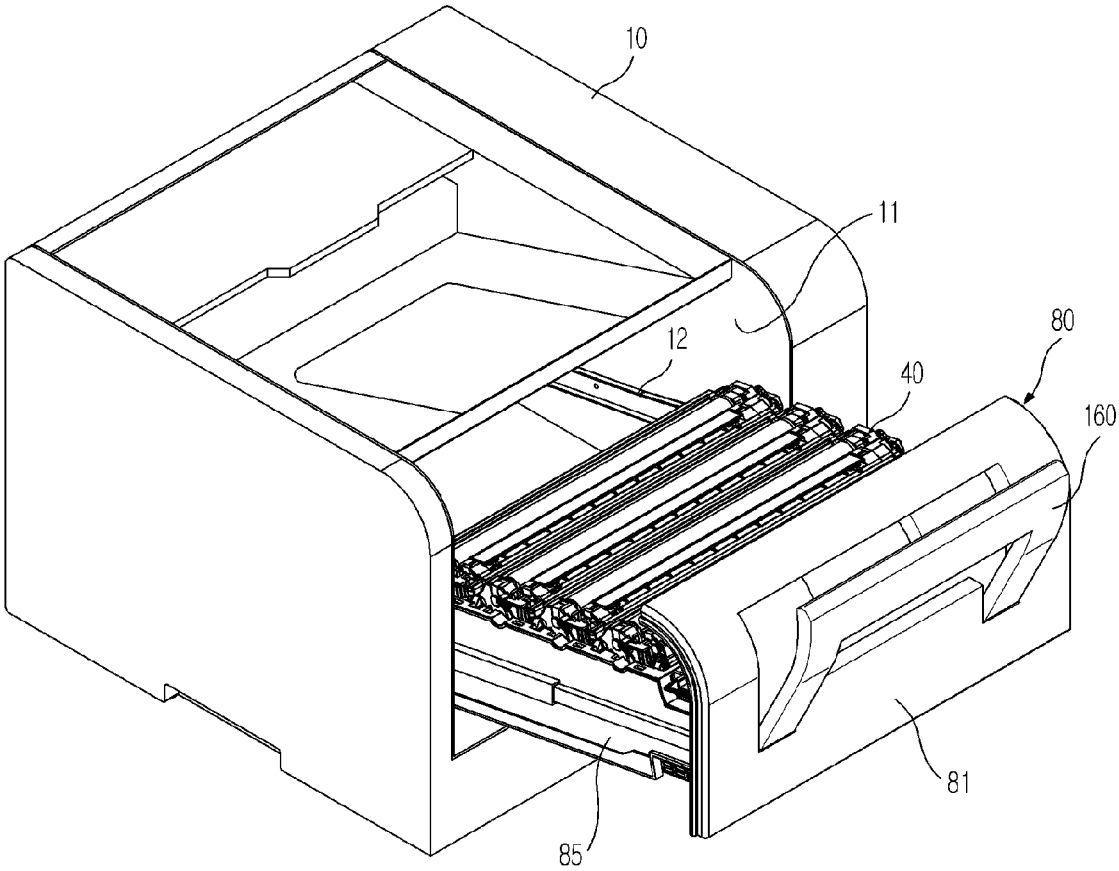
FIG. 22 is a view illustrating an open state of the drawer of the image forming apparatus according to an exemplary embodiment of the present general inventive concept.
Figure 23:
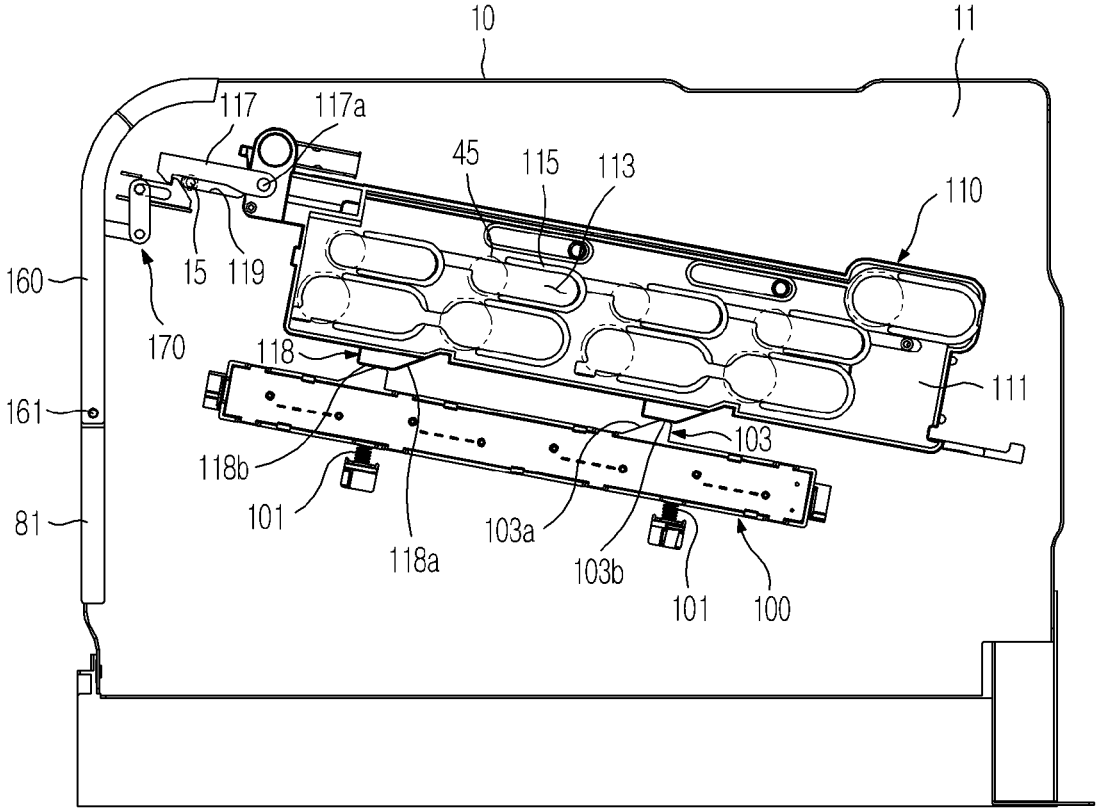
FIG. 23 is a view illustrating a power converting member to operate a coupling connector and a high-voltage connector of FIG. 22.
Figure 24:
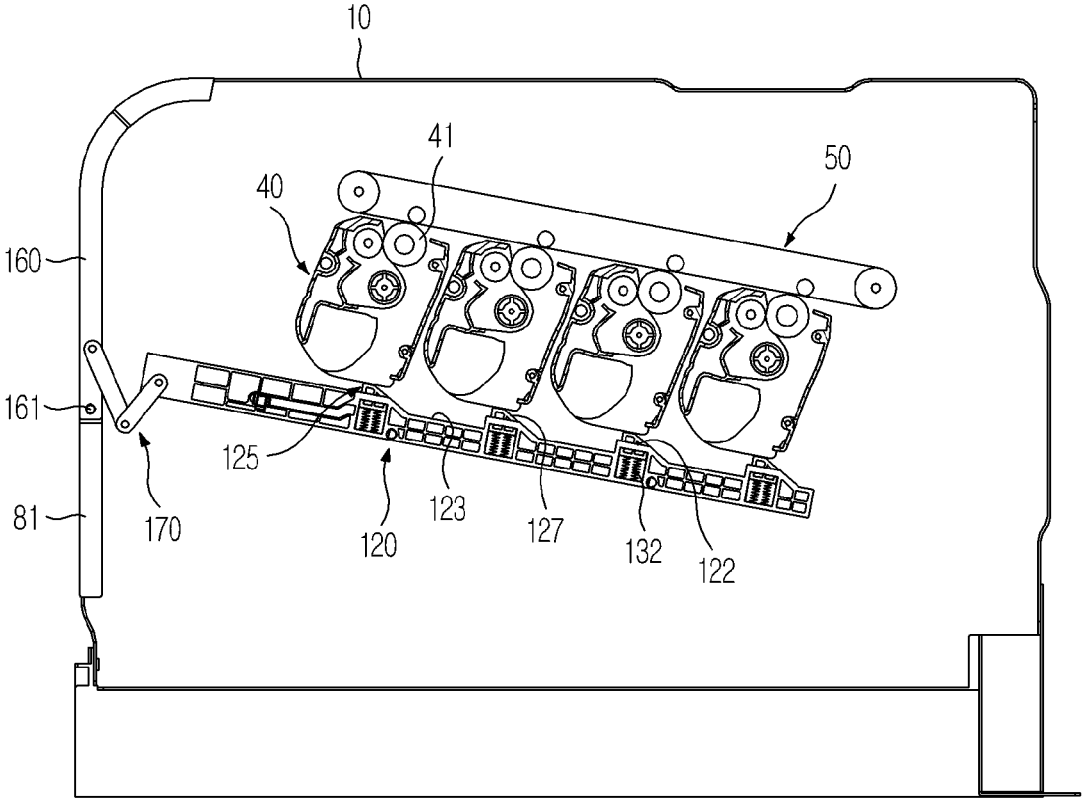
FIG. 24 is a view illustrating the power converting member to operate a drive plate of FIG. 22.

Specifically, as illustrated in FIGS. 22 to 24, the front cover 81 may be provided with a grip 160 to be pivotally rotatable about a rotating shaft 61. The front cover 81 may also be provided with a power converting member 170 to convert rotation of the grip 160 into linear movement of the coupling connector 110 and the drive plate 120.

The power converting member 170 functions to convert rotation of the grip 160 into linear reciprocating motion. Although the present embodiment describes the power converting member 170 as having a conventional link structure, combinations of cams, gears and racks may be possible.

As is apparent from the above description, an image forming apparatus according to the embodiment of the present invention exhibits enhanced exchange convenience of a developing unit.

Although the embodiment of the present general inventive concept has been shown and described, it would be appreciated by those skilled in the art that changes may be made in these embodiments without departing from the principles and spirit of the general inventive concept, the scope of which is defined in the claims and their equivalents.

What is claimed is:

1. An image forming apparatus comprising:

a main body;

a developing unit to form a visible image by feeding developer onto a photoconductor;

a transfer unit placed in the main body to transfer the visible image formed on the photoconductor to a printing medium;

a drawer configured to be slidably pushed into or pulled out of the main body and including a tray to support the developing unit and a front cover defining one surface of the main body and coupled to the tray so as to be moved along with the tray after passing through an operating section in which the front cover is moved relative to the tray;

a coupling connector including a coupling rack to control connection of a coupling so as to transmit power to at least one inner roller of the developing unit;

a Customer Replaceable Unit Module (CRUM) connector to control connection of a terminal so as to transmit developing information to the developing unit;

a drive plate coupled to the front cover so as to vertically move the developing unit between a first position where the photoconductor comes into contact with the transfer unit and a second position where the photoconductor is spaced apart from the transfer unit; and a high-voltage connector to control connection of a terminal so as to apply high-voltage current to the developing unit, wherein the coupling connector, the CRUM connector and the high-voltage connector are disconnected respectively and the developing unit is moved to the second position by the drive plate when the front cover is open, and wherein the coupling connector, the CRUM connector and the high-voltage connector are connected respectively and the developing unit is moved to the first position by the drive plate when the front cover is closed.

2. The apparatus according to claim 1, wherein:

the coupling rack is slidably installed to the main body so as to be selectively moved in linkage with movement of the front cover with respect to a part of the operating section;

the CRUM connector is installed to the main body in linkage with movement of the coupling rack such that the CRUM connector is vertically movable; and the high-voltage connector is installed to the main body in linkage with movement of the tray with respect to a section other than the operating section such that the high-voltage connector is vertically movable.

3. The apparatus according to claim 2, wherein:

the operating section includes a first section in which the front cover is initially pulled out of the main body and a second section in which the front cover is further pulled out of the main body; and the coupling connector and the CRUM connector are disconnected with respect to the first section, and the developing unit is moved to the second position with respect to the second section.

4. The apparatus according to claim 3, wherein at least one of the front cover and the tray is provided with an elongated slot defining the operating section, and the other one of the front cover and the tray is provided with a retainer boss movably inserted in the slot.

5. The apparatus according to claim 3, further comprising a first binding unit to bind the coupling rack to the front cover with respect to the first section and to unbind the coupling rack from the front cover with respect to the second section.

6. The apparatus according to claim 5, wherein the first binding unit includes a coupling operating hook protruding from a rear surface of the front cover, a coupling lever hooked with the coupling operating hook while being rotatably coupled at one end thereof to the coupling rack, the coupling lever having a downwardly-inclined slope at a lower position near the end thereof, and a stud member to upwardly rotate the coupling lever so as to unbind the coupling lever from the coupling operating hook with respect to the second section.

7. The apparatus according to claim 5, further comprising a second binding unit to bind the tray so as to limit movement of the tray while the front cover is pulled out of the main body by the operating section and to unbind the tray so as to enable movement of the tray after passing the operating section.

8. The apparatus according to claim 7, wherein:

the tray has a trap hole and the drive plate has a stepped horizontal guide groove formed in a surface thereof facing the trap hole; and the second binding unit includes a lock-up member rotatably installed about a rotating shaft, the lock-up member being provided at one end thereof with a locking portion extending from the rotating shaft toward the trap hole so as to be caught and supported by the trap hole and at the other end thereof with a guide protrusion extending from the rotating shaft to the guide groove so as to be moved along the guide groove.

9. The apparatus according to claim 8, wherein the guide groove includes a lower first guide groove having a length corresponding to a length of the operating section, an upper second guide groove to rotate the lock-up member, and an inclined groove connecting the first guide groove and the second guide groove to each other.

10. The apparatus according to claim 5, wherein the coupling rack is provided with a coupling slot into which one side of the coupling is inserted and supported, and the coupling slot is provided with an inclined guide to enable movement of the coupling with respect to the first section.

11. The apparatus according to claim 5, wherein:

the CRUM connector is elastically supported by an elastic member while being located beneath the coupling rack and includes a first guide rib protruding upward from an upper end thereof to have an upwardly-inclined first slope and a first horizontal plane; and the coupling rack includes a second guide rib protruding downward from a lower end thereof to have a downwardly-inclined second slope corresponding to the first slope and a second horizontal plane corresponding to the first horizontal plane.

12. The apparatus according to claim 11, wherein:

the first slope and the second slope are brought into contact with each other, causing the CRUM connector to be pushed upward by the elastic member and be disconnected when the coupling rack is pulled out; and the first horizontal plane and the second horizontal plane are brought into contact with each other, causing the CRUM connector to be moved downward and connected when the coupling rack is pushed in.

13. The apparatus according to claim 5, wherein:

the drive plate includes a position guide portion protruding from an upper end thereof to come into contact with a lower surface of the developing unit so as to guide the developing unit between the first position and the second position; and the position guide portion includes a position raising portion to apply pressure to the developing unit so as to locate the developing unit at the first position with respect to the first section, a position lowering portion to locate the developing unit at the second position, and an inclined guiding portion connecting the position raising portion and the position lowering portion to each other to enable vertical movement of the developing unit with respect to the second section.

14. The apparatus according to claim 13, wherein:

the drive plate further includes a pressure unit to elastically support the developing unit at the position raising portion;

the pressure unit includes a lifting member vertically movably installed to the drive plate and a pressure spring to elastically support the lifting member; and the lifting member includes a lifting member slope corresponding to the inclined guiding portion so as to guide the developing unit to the position lowering portion, and a developing unit pressure surface to apply pressure to the developing unit.

15. The apparatus according to claim 7, wherein:

the tray is provided at a side surface thereof with a high-voltage connector lifting guide including a stepped pressure plane and a separation guide slope to enable vertical movement of the high-voltage connector: and the high-voltage connector includes a pressure protrusion to be moved along the high-voltage connector lifting guide and an elastic member to apply elastic force in a direction in which the high-voltage connector is moved downward.

16. An image forming apparatus comprising:

a drawer configured to move a predetermined distance into or out of the image forming apparatus, the drawer comprising:

a front cover;

a tray selectively coupled to the front cover and to support a developing unit; and a drive plate coupled to the front cover; and a coupling connector including a coupling rack to move in linkage with the drawer over a first portion of the predetermined distance to respectively connect and disconnect a drive source and at least one inner roller of the developing unit when the drawer is moved into and out of the image forming apparatus, wherein the drawer moves independent of the coupling rack through the remaining portion of the predetermined distance.

17. The image forming apparatus according to claim 16, further comprising:

a Customer Replaceable Unit Module (CRUM) connector installed in the image forming apparatus to be vertically movable between a first position to connect to the developing unit to transmit developing information to the developing unit and a second position to disconnect from the developing unit; and at least one elastic member to bias the CRUM connector to the second position, wherein the coupling rack includes a guide rib to respectively press the CRUM connector to the first position and release the CRUM connector to the second position when the coupling rack moves over the first portion of the predetermined distance when the drawer is slid into and out of the image forming apparatus.

18. The image forming apparatus according to claim 16, wherein the coupling connector further comprises:

a coupling connector binding unit to couple the coupling rack and the drawer over the first portion of the predetermined distance and to de-couple the coupling rack over the remaining portion of the predetermined distance.

19. The image forming apparatus according to claim 18, wherein the coupling connector binding unit comprises:

a coupling lever to couple the coupling rack and the drawer over the first portion of the predetermined distance while the drawer is moved out of the image forming apparatus; and a stud slot to press against a stud to couple the coupling rack and the drawer over the first portion of the predetermined distance while the drawer is moved into the image forming apparatus.

20. A drawer of an image forming apparatus, the drawer comprising:

a front cover to form an outer surface of the image forming apparatus and configured to move a predetermined distance away from the image forming apparatus when the drawer is opened;

a drive plate coupled to the front cover and to lift a developing unit to contact a transfer unit when the drawer is closed; and a tray to support the developing unit and selectively coupled to the front cover so as to remain stationary while the front cover is moved a first portion of the predetermined distance away from the image forming apparatus and to move in linkage with the front cover while the front cover is moved a remaining portion of the predetermined distance away from the image forming apparatus.

21. The drawer according to claim 20, wherein the drive plate comprises:

a position raising portion;

a position lowering portion disposed at a lower height than the position raising portion; and an inclined guiding portion disposed between the position raising portion and the position lowering portion such that the developing unit slides up the inclined guiding portion from the position lowering portion to the position raising portion when the drawer is closed.

22. The drawer according to claim 20, further comprising:

a slot formed in the front cover; and a retainer boss coupled to the tray such that the retainer boss presses against an end of the slot after the front cover is moved the first portion of the predetermined distance away from the image forming apparatus to couple the tray and the front cover.

23. An image forming apparatus comprising:

a developing unit to develop a latent image on a photoconductor;

a drive source to provide power to at least one inner roller of the developing unit;

a transfer unit to transfer the latent image developed by the developing unit to a printing medium;

a Customer Replaceable Unit Module (CRUM) connector to control connection of a terminal so as to transmit developing information to the developing unit;

a high-voltage connector to control connection of a terminal so as to apply high-voltage current to the developing unit;

a drawer comprising:

a front cover to form an outer surface of the image forming apparatus and configured to move a predetermined distance away from the image forming apparatus when the drawer is opened, the predetermined distance including a first portion, a second portion, and a third portion;

a drive plate coupled to the front cover and to lift a developing unit to contact the transfer unit when the drawer is closed; and a tray to support the developing unit and selectively coupled to the front cover so as to remain stationary while the front cover is moved the first and second portions of the predetermined distance away from the image forming apparatus and to move in linkage with the front cover while the front cover is moved the third portion of the predetermined distance away from the image forming apparatus to disconnect the high-voltage connector; and a coupling connector including a coupling rack to move in linkage with the front cover over the first portion of the predetermined distance to disconnect the drive source and the at least one inner roller of the developing unit and to disconnect the CRUM connector and the developing unit when the drawer is opened, wherein the coupling rack remains stationary when the front cover is moved the second and third portions of the predetermined distance away from the image forming apparatus when the drawer is opened.

24. The image forming apparatus according to claim 23, wherein the drive plate further comprises:

a position raising portion to press against the developing unit to lift the developing unit to contact the transfer unit when the drawer is closed.

25. The image forming apparatus according to claim 23, wherein the tray comprises:

at least one lifting guide formed on a side of the tray to press against the high-voltage connector to connect the high-voltage connector when the drawer is closed and to release the high-voltage connector to disconnect the high-voltage connector when the drawer is opened.

26. The image forming apparatus according to claim 23, wherein the coupling rack comprises:

a guide rib to press against the CRUM connector to connect the CRUM connector when the drawer is closed and to release the CRUM connector to disconnect the CRUM connector when the drawer is opened.

* * * * *